US011682352B2

(12) United States Patent
Zhou et al.

(10) Patent No.: US 11,682,352 B2
(45) Date of Patent: Jun. 20, 2023

(54) ORGANIC LIGHT-EMITTING DISPLAY PANEL

(71) Applicant: SeeYa Optronics, Ltd., Shanghai (CN)

(72) Inventors: Zhiwei Zhou, Shanghai (CN); Dong Qian, Shanghai (CN); Yongcai Shen, Shanghai (CN); Jialing Li, Shanghai (CN)

(73) Assignee: SeeYa Optronics, Ltd., Shanghai (CN)

( * ) Notice: Subject to any disclaimer, the term of this patent is extended or adjusted under 35 U.S.C. 154(b) by 0 days.

(21) Appl. No.: 17/763,603

(22) PCT Filed: Mar. 26, 2021

(86) PCT No.: PCT/CN2021/083262
§ 371 (c)(1),
(2) Date: Mar. 24, 2022

(87) PCT Pub. No.: WO2022/037065
PCT Pub. Date: Feb. 24, 2022

(65) Prior Publication Data

US 2022/0335894 A1 Oct. 20, 2022

(30) Foreign Application Priority Data

Aug. 21, 2020 (CN) ..... 202010846087.X

(51) Int. Cl.
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 2300/0452* (2013.01);
(Continued)

(58) Field of Classification Search
CPC ..... G09G 3/3258; G09G 3/3266; G09G 2300/0452; G09G 2310/0286; G09G 2310/061; G09G 2320/0214
See application file for complete search history.

(56) References Cited

U.S. PATENT DOCUMENTS

2014/0118409 A1 5/2014 Jun et al.

FOREIGN PATENT DOCUMENTS

CN 1417767 A 5/2003
CN 1975846 A 6/2007
(Continued)

OTHER PUBLICATIONS

Chinese Office Action dated Mar. 26, 2021 in connection with Chinese Application No. 202010846087.X.
(Continued)

*Primary Examiner* — Stacy Khoo
(74) *Attorney, Agent, or Firm* — Wolf Greenfield & Sacks, P.C.

(57) ABSTRACT

Provided is an organic light-emitting display panel. Pixel-driving circuits for subpixels with a same color in a same row are connected to a same light emission control signal line, and the pixel-driving circuits of subpixels with the same color in the same row are connected to the same reset control signal line. Pixel-driving circuits of subpixels with different colors in the same row of pixel units are connected to different light emission control signal lines, and the pixel-driving circuits of subpixels with different colors in the same row of pixel units are connected to different reset control signal lines. In a display period of each frame, in part of a period when subpixels with an i-th color in the same row of pixel units are in a light emission stage, anodes of light-emitting element of subpixels with another color in the same row of pixel units are at a reset voltage.

20 Claims, 15 Drawing Sheets

(52) U.S. Cl.
CPC ..... *G09G 2310/0286* (2013.01); *G09G 2310/061* (2013.01); *G09G 2320/0214* (2013.01)

(56) References Cited

FOREIGN PATENT DOCUMENTS

| | | | | |
|---|---|---|---|---|
| CN | 102110410 | A | 6/2011 | |
| CN | 104143311 | A | 11/2014 | |
| CN | 105551433 | A | 5/2016 | |
| CN | 105659311 | A | 6/2016 | |
| CN | 106710525 | A | 5/2017 | |
| CN | 108389550 | A | 8/2018 | |
| CN | 110288948 | A | 9/2019 | |
| CN | 111833816 | A | 10/2020 | |
| WO | WO-2019163402 | A1 * | 8/2019 | ..... G09G 3/3233 |

OTHER PUBLICATIONS

International Search Report dated Jun. 15, 2021 in connection with International Application No. PCT/CN2021/083262.

* cited by examiner

ORGANIC LIGHT-EMITTING DISPLAY PANEL

CROSS REFERENCES TO RELATED APPLICATIONS

This application is a national stage application filed under 35 U.S.C. § 371 based on International Patent Application No. PCT/CN2021/083262, filed on Mar. 26, 2021, which claims priority to Chinese Patent Application No. 202010846087.X filed with the China National Intellectual Property Administration (CNIPA) on Aug. 21, 2020, the disclosures of which are incorporated herein by reference in their entirety.

TECHNICAL FIELD

The present application relates to display technologies, for example, to an organic light-emitting display panel and a driving method.

BACKGROUND

In recent years, organic light-emitting display panels have gradually become the mainstream for screens of mobile display terminals and medium-and-large-sized display screens. An organic light-emitting display panel includes multiple subpixels arranged in an array. Each subpixel includes a pixel-driving circuit and a light-emitting element electrically connected to the pixel-driving circuit.

In the related art, each light-emitting element includes an anode, a hole auxiliary transport layer, a light-emitting layer, an electron auxiliary transport layer and a cathode which are stacked. To increase the density of subpixels or to manufacture relatively-small-sized display panels, each of a hole auxiliary transport layer, a light-emitting layer and an electron auxiliary transport layer of light-emitting elements emitting different colors is an integral film layer, and each of the hole auxiliary transport layer, the light-emitting layer and the electron auxiliary transport layer of the light-emitting elements is not divided. Since each of a hole auxiliary transport layer, a light-emitting layer and an electron auxiliary transport layer of adjacent light-emitting elements is an integral film layer, when a certain light-emitting element emits light, holes injected by the anode of the light-emitting element may be partially transmitted to an adjacent light-emitting element through the hole auxiliary transport layer, so that a lateral leakage current is generated. The leakage current affects the signal voltage of the adjacent light-emitting element, thereby leading to blurring and color mixing of images.

SUMMARY

The present application provides an organic light-emitting display panel and a driving method, so as to avoid the problem that a leakage current generated between adjacent light-emitting elements affects the display effect.

In a first aspect, an embodiment of the present application provides an organic light-emitting display panel. The organic light-emitting display panel includes a plurality of pixel units, where each of the plurality of pixel units includes a plurality of subpixels with different colors.

Each of the plurality of subpixels includes a pixel-driving circuit and a light-emitting element electrically connected to the pixel-driving circuit; the light-emitting element includes a common layer; and common layers of adjacent light-emitting elements are disposed in a same layer and connected to each other.

Pixel-driving circuits of subpixels with a same color in a same row are connected to a same light emission control signal line; and in a case where the light emission control signal line transmits an effective light emission control pulse, the subpixels to which the pixel-driving circuits electrically connected to the light emission control signal line belong are in a light emission stage.

The pixel-driving circuits of the subpixels with the same color in the same row are connected to a same reset control signal line; and in a case where the reset control signal line transmits an effective reset pulse, anodes of light-emitting elements of the subpixels to which the pixel-driving circuits electrically connected to the reset control signal line belong are at a reset voltage, and the subpixels to which the pixel-driving circuits electrically connected to the reset control signal line belong are in a non-light-emission stage.

Pixel-driving circuits of subpixels with different colors in a same row of pixel units are connected to different light emission control signal lines; and the pixel-driving circuits of the subpixels with different colors in the same row of pixel units are connected to different reset control signal lines.

In a display period of each frame of image, in at least part of a time period during which subpixels with an i-th color in a same row of pixel units are in a light emission stage, anodes of light-emitting elements of subpixels with another color in the same row of pixel units are at a reset voltage to lead out a leakage current, where the leakage current is generated by the subpixels with the i-th color through common layers, and i is a positive integer.

In the display period of each frame of image, light emission stages of subpixels with different colors in a same row of pixel units do not overlap.

In a second aspect, an embodiment of the present application further provides a driving method of an organic light-emitting display panel. The driving method includes steps described below.

In step S11, in at least part of a light emission stage of subpixels with an i-th color in a same row of pixel units, a potential of a light emission control signal line of the subpixels with the i-th color is controlled to be a first level, a potential of a light emission control signal line of subpixels with another color in the same row of pixel units is controlled to be a second level, a potential of a reset control signal line of the subpixels with the i-th color in the same row of pixel units is controlled to be a third level, and a potential of a reset control signal line of the subpixels with the another color in the same row of pixel units is controlled to be a fourth level, so that anodes of light-emitting elements of the subpixels with the another color in the same row of pixel units are at a reset voltage and the subpixels with the another color in the same row of pixel units to be in a non-light-emission stage, and a leakage current generated through common layers by the subpixels with the i-th color is led out.

In step S12, in at least part of a light emission stage of subpixels with an (i+1)-th color in the same row of pixel units, a potential of a light emission control signal line of the subpixels with the (i+1)-th color is controlled to be the first level, a potential of a light emission control signal line of subpixels with another color in the same row of pixel units is controlled to be the second level, a potential of a reset control signal line of the subpixels with the (i+1)-th color in the same row of pixel units is controlled to be the third level, and a potential of a reset control signal line of the subpixels with the another color in the same row of pixel units is controlled to be the fourth level, so as to enable anodes of light-emitting elements of the subpixels with the another color in the same row of pixel units to be at a reset voltage and the subpixels with the another color in the same row of pixel units to be in a non-light-emission stage, so that a leakage current generated through the common layers by the subpixels with the (i+1)-th color is led out.

Step S11 and step S12 are circularly executed until subpixels with all colors in the same row of pixel units sequentially complete light emission.

i is a positive integer; the first level is an effective light emission control pulse; the second level is an ineffective light emission control pulse; the third level is an ineffective reset control pulse; and the fourth level is an effective reset control pulse.

In the organic light-emitting display panel provided by the embodiment of the present application, pixel-driving circuits of subpixels with a same color in a same row are connected to a same light emission control signal line; and in a case where the light emission control signal line transmits an effective light emission control pulse, the subpixels to which the pixel-driving circuits electrically connected to the light emission control signal line belong are in a light emission stage. The pixel-driving circuits of the subpixels with the same color in the same row are connected to a same reset control signal line; and in a case where the reset control signal line transmits an effective reset pulse, anodes of light-emitting elements of the subpixels to which the pixel-driving circuits electrically connected to the reset control signal line belong are at a reset voltage, and the subpixels to which the pixel-driving circuits electrically connected to the reset control signal line belong are in a non-light-emission stage. Pixel-driving circuits of subpixels with different colors in a same row of pixel units are connected to different light emission control signal lines; and the pixel-driving circuits of the subpixels with different colors in the same row of pixel units are connected to different reset control signal lines. In a display period of each frame of image, it may be controlled that in at least part of a time period during which subpixels with an i-th color in a same row of pixel units are in a light emission stage, anodes of light-emitting elements of subpixels with another color in the same row of pixel units are at a reset voltage. In this way, crosstalk caused by a leakage current generated between subpixels with different colors can be avoided.

DETAILED DESCRIPTION

Figure 1:
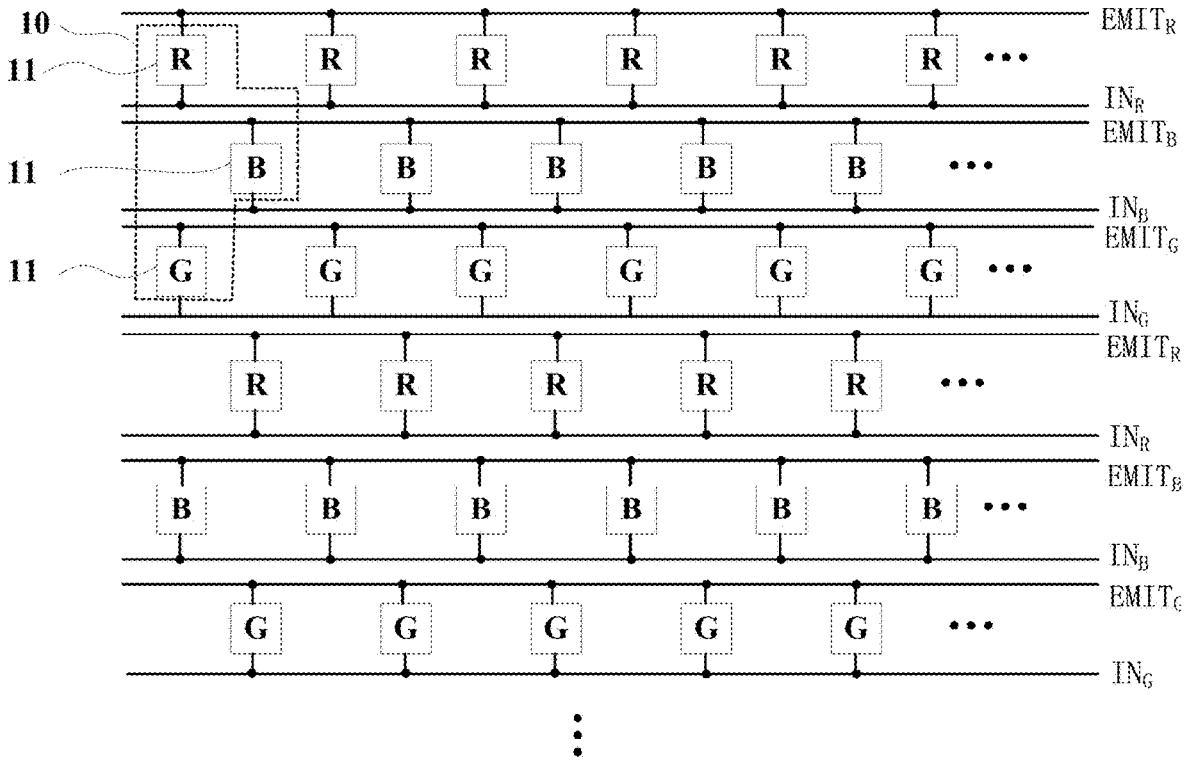
FIG. 1 is a structural diagram of an organic light-emitting display panel according to an embodiment of the present application.

The embodiment of the present application provides an organic light-emitting display panel. The organic light-emitting display panel includes multiple pixel units, and each of the multiple pixel units includes multiple subpixels with different colors for achieving color display. Each of the multiple subpixels includes a pixel-driving circuit and a light-emitting element electrically connected to the pixel-driving circuit. The pixel-driving circuit is configured to drive the electrically connected light-emitting element to emit light. The light-emitting element includes a common layer; and common layers of adjacent light-emitting elements are disposed in a same layer and connected to each other. That is, the common layer is an integral film layer without interruption between light-emitting elements. The common layer may include, for example, at least one of a hole auxiliary transport layer, a light-emitting layer or an electron auxiliary transport layer.

Pixel-driving circuits of subpixels with a same color in a same row are connected to a same light emission control signal line. In a case where the light emission control signal line transmits an effective light emission control pulse, the subpixels to which the pixel-driving circuits electrically connected to the light emission control signal line belong are in a light emission stage.

The pixel-driving circuits of the subpixels with the same color in the same row are connected to a same reset control signal line. In a case where the reset control signal line transmits an effective reset pulse, anodes of light-emitting elements of the subpixels to which the pixel-driving circuits electrically connected to the reset control signal line belong are at a reset voltage, and the subpixels to which the pixel-driving circuits electrically connected to the reset control signal line belong are in a non-light-emission stage.

Pixel-driving circuits of subpixels with different colors in a same row of pixel units are connected to different light emission control signal lines; and the pixel-driving circuits of the subpixels with different colors in the same row of pixel units are connected to different reset control signal lines.

In a display period of each frame of image, in at least part of a time period during which subpixels with an i-th color in a same row of pixel units are in a light emission stage, anodes of light-emitting elements of subpixels with another color in the same row of pixel units are at a reset voltage to lead out a leakage current, where the leakage current is generated by the subpixels with the i-th color through common layers, and i is a positive integer.

That is, in at least part of a time period during which subpixels with an i-th color in a same row of pixel units are in a light emission stage, a reset voltage is applied to anodes of light-emitting elements of subpixels with another color in the same row of pixel units, and the anodes are reset and do not emit light. Therefore, if subpixels which are emitting light generate a leakage current to adjacent subpixels with another color, the leakage current can be led out due to the reset voltage of anodes of light-emitting elements of the adjacent subpixels, so that crosstalk between subpixels with different colors can be avoided.

The above is the core idea of the present application. Technical solutions in the embodiments of the present application will be described clearly and completely in conjunction with the drawings in the embodiments of the present application. Based on embodiments of the present application, all other embodiments obtained by those of ordinary skill in the art without creative work are within the scope of the present application.

FIG. 1 is a structural diagram of an organic light-emitting display panel according to an embodiment of the present application. As shown in FIG. 1, the organic light-emitting display panel includes multiple pixel units 10, and each pixel unit 10 includes multiple subpixels 11 with different colors. In FIG. 1, exemplarily, each pixel unit 10 includes a red subpixel R, a green subpixel G and a blue subpixel B. Each subpixel 11 includes a pixel-driving circuit and a light-emitting element (not shown FIG. 1) electrically connected to the pixel-driving circuit.

Pixel-driving circuits of subpixels with a same color in a same row are connected to a same light emission control signal line. In a case where the light emission control signal line transmits an effective light emission control pulse, the subpixels to which the pixel-driving circuits electrically connected to the light emission control signal line belong are in a light emission stage. It should be noted that subpixels being in a light emission stage refers to a time period during which the subpixels are in a light emission state. As shown in FIG. 1, pixel-driving circuits of red subpixels R in a same row of pixel units are connected to a same light emission control signal line $EMIT_R$. Pixel-driving circuits of green subpixels G in a same row of pixel units are connected to a same light emission control signal line $EMIT_G$. Pixel-driving circuits of blue subpixels B in a same row of pixel units are connected to a same light emission control signal line $EMIT_B$.

The pixel-driving circuits of the subpixels with the same color in the same row are connected to a same reset control signal line. In a case where the reset control signal line transmits an effective reset pulse, anodes of light-emitting elements of the subpixels to which the pixel-driving circuits electrically connected to the reset control signal line belong are at a reset voltage, and the subpixels to which the pixel-driving circuits electrically connected to the reset control signal line belong are in a non-light-emission stage. As shown in FIG. 1, pixel-driving circuits of red subpixels R in a same row of pixel units are connected to a same reset control signal line $IN_R$. Pixel-driving circuits of green subpixels G in a same row of pixel units are connected to a same reset control signal line $IN_G$. Pixel-driving circuits of blue subpixels B in a same row of pixel units are connected to a same reset control signal line $IN_B$.

Pixel-driving circuits of subpixels with different colors in a same row of pixel units are connected to different light emission control signal lines; and the pixel-driving circuits of the subpixels with different colors in the same row of pixel units are connected to different reset control signal lines. As shown in FIG. 1, pixel-driving circuits of red subpixels, pixel-driving circuits of green subpixels and pixel-driving circuits of blue subpixels in a same row of pixel units are connected to different light emission control signal lines, and the pixel-driving circuits of the red subpixels, the pixel-driving circuits of the green subpixels and the pixel-driving circuits of the blue subpixels in the same row of pixel units are connected to different reset control signal lines. That is, as shown in FIG. 1, each row of pixel units is correspondingly provided with n light emission control signal lines and n reset control signal lines, where n is the number of colors of subpixels in a pixel unit.

In a display period of each frame of image, in at least part of a time period during which subpixels with an i-th color in a same row of pixel units are in a light emission stage, anodes of light-emitting elements of subpixels with another color in the same row of pixel units are at a reset voltage, where i is a positive integer.

For example, in at least part of a time period during which red subpixels in a same row of pixel units are in a light emission stage, anodes of light-emitting elements of subpixels with another color in the same row of pixel units are at a reset voltage, and the subpixels with the another color in the same row of pixel units are in a reset stage and do not emit light in the reset stage. If holes injected by anodes of the red subpixels are partially transmitted to green subpixels or blue subpixels adjacent to the red subpixels, the leakage current can be led out due to the reset voltage of anodes of light-emitting elements of the green subpixels or the blue subpixels, so that crosstalk between subpixels with different colors can be avoided.

Optionally, in the embodiment of the present application, in the display period of each frame of image, light emission stages of subpixels with different colors in a same row of pixel units may be controlled not to overlap. To achieve good display effect, preferably, in the embodiment of the present application, in the display period of each frame of image, light emission stages of subpixels with different colors in a same row of pixel units are controlled not to overlap. Therefore, when subpixels with an i-th color are in a light emission stage, subpixels with another color do not emit light, and anodes of light-emitting elements are at a reset voltage, so that crosstalk between subpixels with different colors can be avoided in an entire light emission stage of subpixels with each color.

Optionally, the organic light-emitting display panel provided by the embodiment of the present application further includes multiple first scan driver circuits and multiple second scan driver circuits. Each of the multiple first scan driver circuits is electrically connected to light emission control signal lines corresponding to rows of subpixels with a same color, and different first scan driver circuits of the multiple first scan driver circuits are connected to light emission control signal lines corresponding to subpixels with different colors. Each of the multiple second scan driver circuits is electrically connected to reset control signal lines corresponding to the rows of subpixels with the same color, and different second scan driver circuits of the multiple second scan driver circuits are connected to reset control signal lines corresponding to the subpixels with different colors.

The each of the multiple first scan driver circuits includes multiple cascaded first shift registers, and the each of the multiple second scan driver circuits includes multiple cascaded second shift registers. At least two adjacent light emission control signal lines connected to pixel-driving circuits of subpixels with a same color composes a light emission control signal line group, and each light emission control signal line in the light emission control signal line group is connected to a same first shift register of the multiple cascaded first shift registers. At least two adjacent reset control signal lines connected to the pixel-driving circuits of the subpixels with the same color composes a reset control signal line group, and each reset control signal line in the reset control signal line group is connected to a same second shift register of the multiple cascaded second shift registers.

In the embodiment of the present application, the first scan driver circuits input a light emission control signal to each light emission control signal line, and the second scan driver circuits input a reset control signal to each reset control signal line. Each light emission control signal line in the light emission control signal line group is connected to a same first shift register. Since each light emission control signal line group includes at least two adjacent light emission control signal lines connected to pixel-driving circuits of subpixels with a same color, at least two rows of subpixels with the same color can emit light simultaneously, so that the driving period can be reduced, and the number of first shift registers in first scan driver circuits can be reduced. Similarly, each reset control signal line in the reset control signal line group is connected to a same second shift register. Since each reset control signal line group includes at least two adjacent reset control signal lines connected to pixel-driving circuits of subpixels with a same color, anodes of light-emitting elements of at least two rows of subpixels with the same color can be reset simultaneously, so that the driving period can be reduced, and the number of second shift registers in second scan driver circuits can be reduced.

Figure 2:
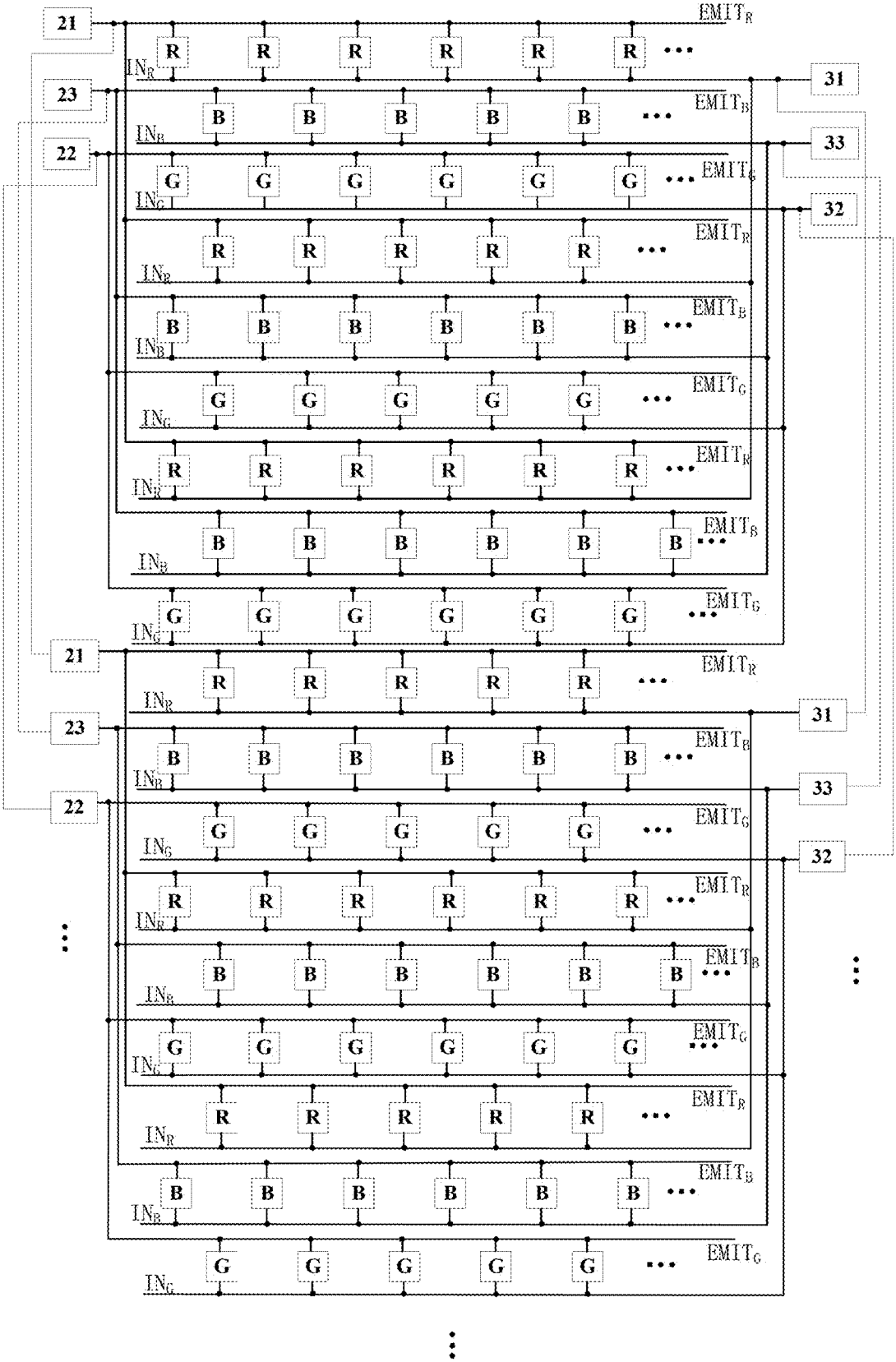
FIG. 2 is a structural diagram of another organic light-emitting display panel according to an embodiment of the present application.

FIG. 2 is a structural diagram of another organic light-emitting display panel according to an embodiment of the present application. As shown in FIG. 2, an example is illustrated in which each pixel unit includes a red subpixel R, a blue subpixel B and a green subpixel G. The organic light-emitting display panel includes three first scan driver circuits and three second scan driver circuits. The three first scan driver circuits are $GIP\mathbf{1}_R$, $GIP\mathbf{1}_G$ and $GIP\mathbf{1}_B$, respectively. $GIP\mathbf{1}_R$ is electrically connected to light emission control signal lines $EMIT_R$ corresponding to rows of red subpixels R, $GIP_G$ is electrically connected to light emission control signal lines $EMIT_G$ corresponding to rows of green subpixels G, and $GIP_B$ is electrically connected to light emission control signal lines $EMIT_B$ corresponding to rows of blue subpixels B. The three second scan driver circuits are $GIP\mathbf{2}_R$, $GIP\mathbf{2}_G$ and $GIP\mathbf{2}_B$, respectively. $GIP\mathbf{2}_R$ is electrically connected to reset control signal lines $IN_R$ corresponding to the rows of red subpixels R, $GIP\mathbf{2}_G$ is electrically connected to reset control signal lines $IN_G$ corresponding to the rows of green subpixels G, and $GIP\mathbf{2}_B$ is electrically connected to reset control signal lines $IN_B$ corresponding to the rows of blue subpixels B. The first scan driver circuit $GIP\mathbf{1}_R$ includes multiple cascaded first shift registers 21, the first scan driver circuit $GIP\mathbf{1}_R$ includes multiple cascaded first shift registers 21, the first scan driver circuit $GIP\mathbf{1}_G$ includes multiple cascaded first shift registers 22, and the first scan driver circuit $GIP\mathbf{1}_B$ includes multiple cascaded first shift registers 23. The second scan driver circuit $GIP\mathbf{2}_R$ includes multiple cascaded second shift registers 31, the second scan driver circuit $GIP\mathbf{2}_G$ includes multiple cascaded second shift registers 32, and the second scan driver circuit $GIP\mathbf{2}_B$ includes multiple cascaded second shift registers 33.

Each three adjacent light emission control signal lines $EMIT_R$ composes a light emission control signal line group, and three adjacent light emission control signal lines $EMIT_R$ belonging to a same light emission control signal line group are connected to a same first shift register 21. Each three adjacent light emission control signal lines $EMIT_G$ composes a light emission control signal line group, and three adjacent light emission control signal lines $EMIT_G$ belonging to a same light emission control signal line group are connected to a same first shift register 22. Each three adjacent light emission control signal lines $EMIT_B$ composes a light emission control signal line group, and three adjacent light emission control signal lines $EMIT_B$ belonging to a same light emission control signal line group are connected to a same first shift register 23. Each three adjacent reset control signal lines $IN_R$ composes a reset control signal line group, and three adjacent reset control signal lines $IN_R$ belonging to a same reset control signal line group are connected to a same second shift register 31. Each three adjacent reset control signal lines $IN_G$ composes a reset control signal line group, and three adjacent reset control signal lines $IN_G$ belonging to a same reset control signal line group are connected to a same second shift register 32. Each three adjacent reset control signal lines $IN_B$ composes a reset control signal line group, and three adjacent reset control signal lines $IN_B$ belonging to a same reset control signal line group are connected to a same second shift register 33.

It should be noted that FIG. 2 exemplarily shows that three adjacent light emission control signal lines connected to pixel-driving circuits of subpixels with a same color composes a light emission control signal line group, and three adjacent reset control signal lines connected to pixel-driving circuits of subpixels with a same color composes a reset control signal line group, which is not to limit the embodiments of the preset application. In the process of actual applications, the number of light emission control signal lines in a light emission control signal line group and the number of reset control signal lines in a reset control signal line group may be set according to requirements of a product.

Figure 3:
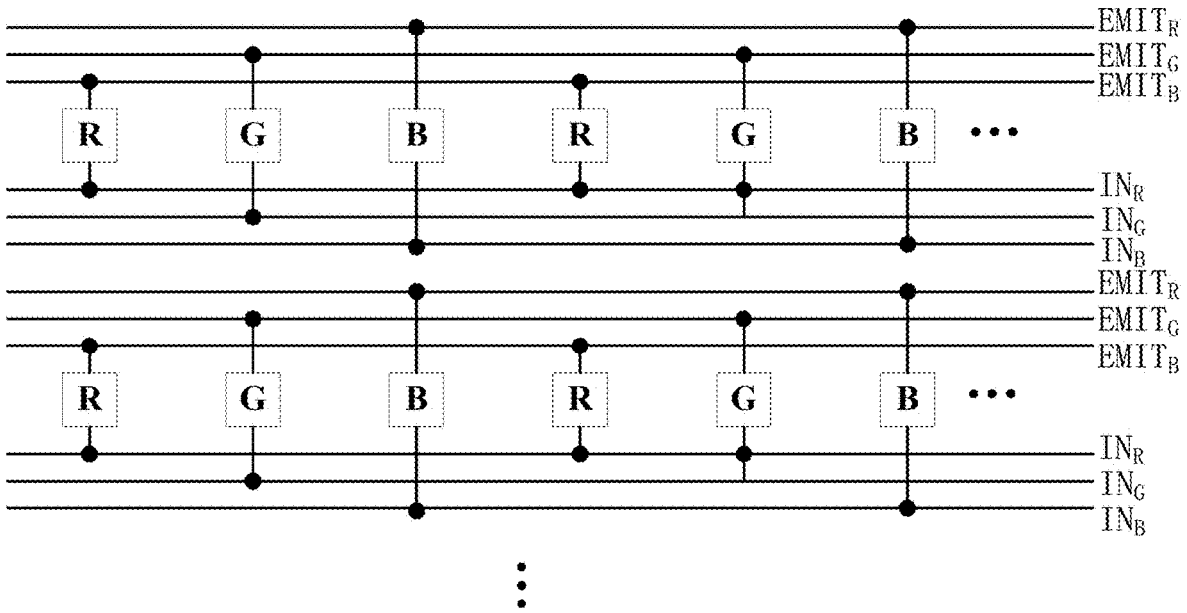
FIG. 3 is a structural diagram of another organic light-emitting display panel according to an embodiment of the present application.

In addition, the arrangement of subpixels in the organic light-emitting display panel is not limited in the embodiments of the present application, and the arrangement of subpixels in FIG. 2 is merely a specific example. Other arrangement forms of pixels, such as the arrangement of subpixels shown in FIG. 3, may further be selected according to design requirements of a product. In FIG. 2, subpixels in each pixel unit are arranged in a triangle manner, and in FIG. 3, subpixels in each pixel unit are arranged sequentially in a pixel unit row direction.

Optionally, in the embodiment of the present application, multiple first scan driver circuits and multiple second scan driver circuits are included. Each of the multiple first scan driver circuits is electrically connected to light emission control signal lines corresponding to rows of subpixels with a same color, and different first scan driver circuits of the multiple first scan driver circuits are connected to light emission control signal lines corresponding to subpixels with different colors. Each of the multiple second scan driver circuits is electrically connected to reset control signal lines corresponding to the rows of subpixels with the same color, and different second scan driver circuits of the multiple second scan driver circuits are connected to reset control signal lines corresponding to the subpixels with different colors. The each of the multiple first scan driver circuits includes multiple cascaded first shift registers, and the each of the multiple second scan driver circuits includes multiple cascaded second shift registers. Light emission control signal lines corresponding to rows of subpixels with a same color are electrically connected to multiple cascaded first shift registers of a same first scan driver circuit in a one-to-one correspondence, and reset control signal lines corresponding to the rows of subpixels with the same color are electrically connected to multiple cascaded second shift registers of a same second scan driver circuit in the one-to-one correspondence.

In the embodiment of the present application, subpixels with each color are provided with one first scan driver circuit and one second scan driver circuit. Rows of light emission control signal lines of subpixels with each color are electrically connected to first shift registers of the one first scan driver circuit in a one-to-one correspondence, and rows of reset control signal lines of the subpixels with the each color are electrically connected to second shift registers of the one second driver circuit in a one-to-one correspondence.

Figure 4:
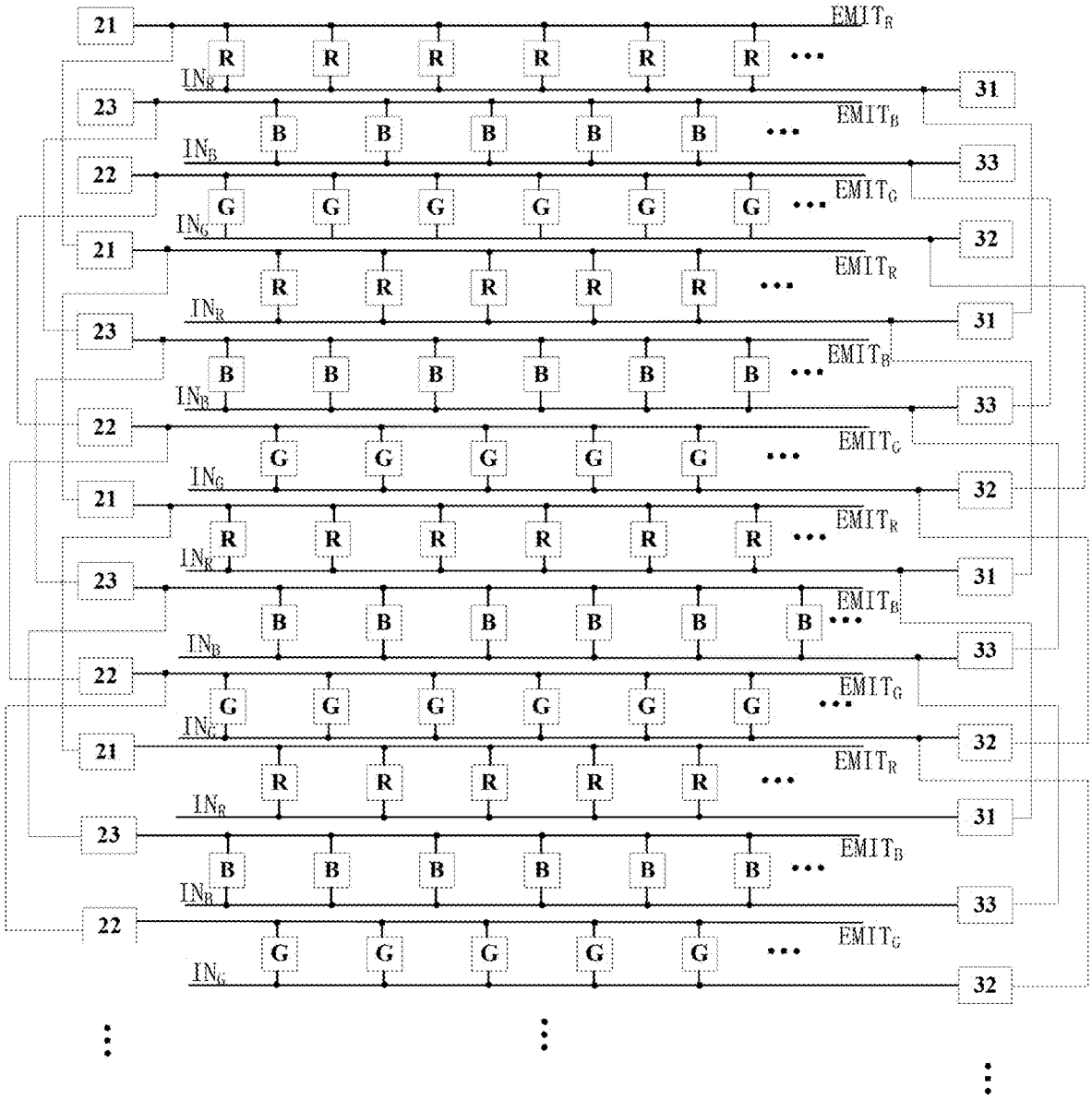
FIG. 4 is a structural diagram of another organic light-emitting display panel according to an embodiment of the present application.

FIG. 4 is a structural diagram of another organic light-emitting display panel according to an embodiment of the present application. An example is illustrated in which each pixel unit 10 includes a red subpixel R, a blue subpixel B and a green subpixel G. The organic light-emitting display panel includes three first scan driver circuits and three second scan driver circuits. The three first scan driver circuits are $GIP\mathbf{1}_R$, $GIP\mathbf{1}_G$ and $GIP\mathbf{1}_B$, respectively. $GIP\mathbf{1}_R$ is electrically connected to light emission control signal lines $EMIT_R$ corresponding to rows of red subpixels R, $GIP\mathbf{1}_G$ is electrically connected to light emission control signal lines $EMIT_G$ corresponding to rows of green subpixels G, and $GIP\mathbf{1}_B$ is electrically connected to light emission control signal lines $EMIT_B$ corresponding to rows of blue subpixels B. The three second scan driver circuits are $GIP\mathbf{2}_R$, $GIP\mathbf{2}_G$ and $GIP\mathbf{2}_B$, respectively. $GIP\mathbf{2}_R$ is electrically connected to reset control signal lines $IN_R$ corresponding to the rows of red subpixels R, $GIP\mathbf{2}_G$ is electrically connected to reset control signal lines $IN_G$ corresponding to the rows of green subpixels G, and $GIP\mathbf{2}_B$ is electrically connected to reset control signal lines $IN_B$ corresponding to the rows of blue subpixels B. The first scan driver circuit $GIP\mathbf{1}_R$ includes multiple cascaded first shift registers 21, the first scan driver circuit $GIP\mathbf{1}_R$ includes multiple cascaded first shift registers 21, the first scan driver circuit $GIP\mathbf{1}_G$ includes multiple cascaded first shift registers 22, and the first scan driver circuit $GIP\mathbf{1}_B$ includes multiple cascaded first shift registers 23. The second scan driver circuit $GIP\mathbf{2}_R$ includes multiple cascaded second shift registers 31, the second scan driver circuit $GIP\mathbf{2}_G$ includes multiple cascaded second shift registers 32, and the second scan driver circuit $GIP\mathbf{2}_B$ includes multiple cascaded second shift registers 33.

The light emission control signal lines $EMIT_R$ corresponding to the rows of red subpixels are electrically connected to the multiple cascaded first shift registers 21 of the first scan driver circuit $GIP\mathbf{1}_R$ in a one-to-one correspondence, the light emission control signal lines $EMIT_G$ corresponding to the rows of green subpixels are electrically connected to the multiple cascaded first shift registers 22 of the first scan driver circuit $GIP\mathbf{1}_G$ in the one-to-one correspondence, and the light emission control signal lines $EMIT_B$ corresponding to the rows of blue subpixels are electrically connected to the multiple cascaded first shift registers 23 of the first scan driver circuit $GIP\mathbf{1}_B$ in the one-to-one correspondence. The reset control signal lines $IN_R$ corresponding to the rows of red subpixels are electrically connected to the multiple cascaded second shift registers 31 of the same second scan driver circuit $GIP\mathbf{2}_R$ in the one-to-one correspondence, the reset control signal lines $IN_G$ corresponding to the rows of green subpixels are electrically connected to the multiple cascaded second shift registers 32 of the same second scan driver circuit $GIP\mathbf{2}_G$ in the one-to-one correspondence, and the reset control signal lines $IN_B$ corresponding to the rows of blue subpixels are electrically connected to the multiple cascaded second shift registers 33 of the same second scan driver circuit $GIP\mathbf{2}_G$ in the one-to-one correspondence.

Optionally, in the organic light-emitting display panel provided by the embodiment of the present application, light emission control signal lines corresponding to subpixels with a same color may be electrically connected to each other, and reset control signal lines corresponding to the subpixels with the same color may be electrically connected to each other. Therefore, in the display period of each frame of image, subpixels with a same color emit light simultaneously, and subpixels with different colors emit light sequentially.

Figure 5:
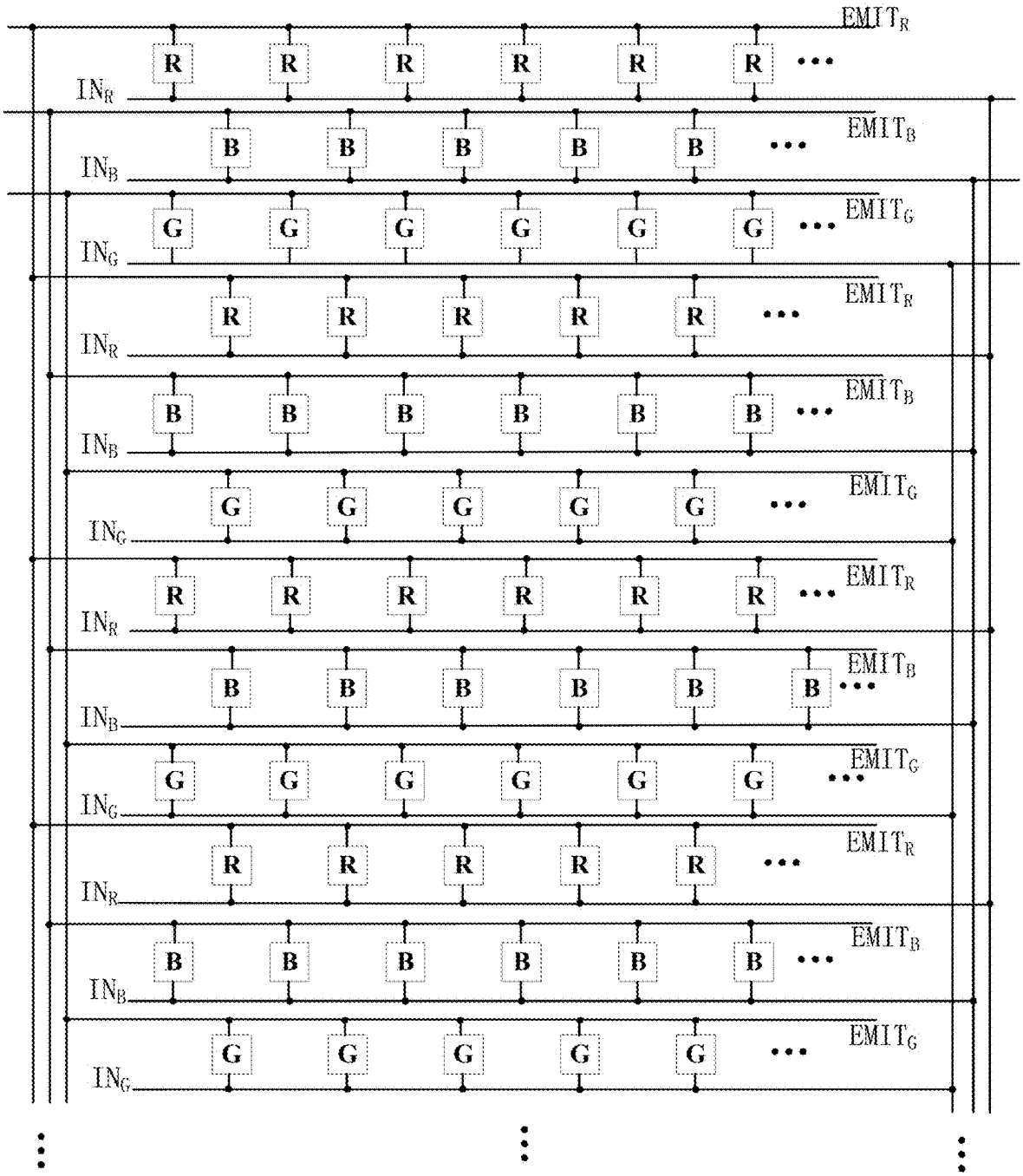
FIG. 5 is a structural diagram of another organic light-emitting display panel according to an embodiment of the present application.

FIG. 5 is a structural diagram of another organic light-emitting display panel according to an embodiment of the present application. As shown in FIG. 5, light emission control signal lines corresponding to subpixels with a same color are electrically connected to each other, and reset control signal lines corresponding to the subpixels with the same color are electrically connected to each other. An example is illustrated in which each pixel unit includes a red subpixel R, a green subpixel G and a blue subpixel B. With continuous reference to FIG. 5, light emission control signal lines $EMIT_R$ corresponding to rows of red subpixels R are electrically connected to each other, light emission control signal lines $EMIT_G$ corresponding to rows of green subpixels G are electrically connected to each other, and light emission control signal lines $EMIT_B$ corresponding to rows of blue subpixels B are electrically connected to each other. Therefore, in the display period of each frame of image, subpixels with the three colors emit light sequentially.

Figure 6:
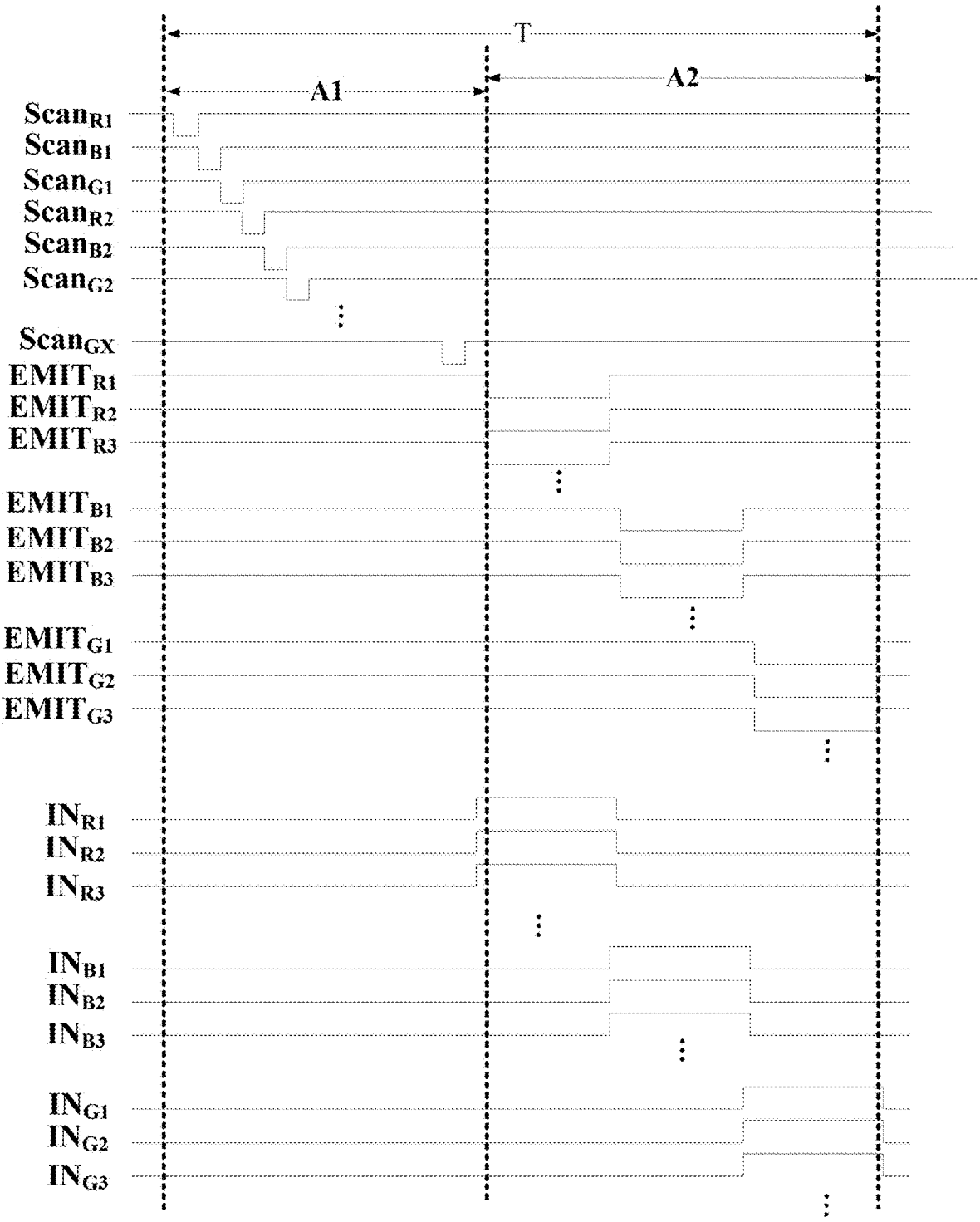
FIG. 6 is a driving timing diagram of an organic light-emitting display panel according to an embodiment of the present application.

FIG. 6 is a driving timing diagram of an organic light-emitting display panel according to an embodiment of the present application. As shown in FIG. 6, in a light emission control stage A2 of display period of each frame of image T, all red subpixels emit light simultaneously, all green subpixels emit light simultaneously, all blue subpixels emit light simultaneously, and subpixels with different colors emit light sequentially. Exemplarily, the order of light emission shown in FIG. 6 is from red subpixels to blue subpixels and to green subpixels. $EMIT_{RX}$ refers to a light emission control signal transmitted by a light emission control signal line to which red subpixels in the X-th row of pixel units are electrically connected, $EMIT_{GX}$ refers to a light emission control signal transmitted by a light emission control signal line to which green subpixels in the X-th row of pixel units are electrically connected, and $EMIT_{BX}$ refers to a light emission control signal transmitted by a light emission control signal line to which blue subpixels in the X-th row of pixel units are electrically connected. $IN_{RX}$ refers to a reset control signal transmitted by a reset control signal line to which the red subpixels in the X-th row of pixel units are electrically connected, $IN_{GX}$ refers to a reset control signal transmitted by a reset control signal line to which the green subpixels in the X-th row of pixel units are electrically connected, and $IN_{BX}$ refers to a reset control signal transmitted by a reset control signal line to which the blue subpixels in the X-th row of pixel units are electrically connected. X is a positive integer. It can be seen from FIG. 6 that the light emission control stage A2 of the each frame image display period T may be divided into three stages, that is, a first stage during which the red subpixels emit light, a second stage during which the blue subpixels emit light and a third stage during which the green subpixels emit light.

In the first stage, light emission control signal lines corresponding to rows of red subpixels transmit an effective light emission control pulse (In FIG. 6, the effective light emission control pulse is exemplarily set to a low level, similarly in the following drawings), and red subpixels emit light; light emission control signal lines corresponding to rows of blue subpixels and light emission control signal lines corresponding to rows of green subpixels transmit an ineffective light emission control pulse (In FIG. 6, the ineffective light emission control pulse is exemplarily set to a high level, similarly in the following drawings), and the rows of blue subpixels and the rows of green subpixels do not emit light. Moreover, reset control signal lines corresponding to the rows of blue subpixels and reset control signal lines corresponding to the rows of green subpixels transmit an effective reset pulse, and anodes of light-emitting elements of the rows of blue subpixels and anodes of light-emitting elements of the rows of green subpixels are at a reset voltage. In the second stage, the light emission control signal lines corresponding to the rows of blue subpixels transmit an effective light emission control pulse (In FIG. 6, the effective light emission control pulse is exemplarily set to a low level, similarly in the following drawings), and blue subpixels emit light; the light emission control signal lines corresponding to the rows of red subpixels and the light emission control signal lines corresponding to the rows of green subpixels transmit an ineffective light emission control pulse (In FIG. 6, the ineffective light emission control pulse is exemplarily set to a high level, similarly in the following drawings), and the rows of red subpixels and the rows of green subpixels do not emit light. Moreover, reset control signal lines corresponding to the rows of red subpixels and the reset control signal lines corresponding to the rows of green subpixels transmit an effective reset pulse, and anodes of light-emitting elements of the rows of red subpixels and the anodes of the light-emitting elements of the rows of green subpixels are at a reset voltage. In the third stage, the light emission control signal lines corresponding to the rows of green subpixels transmit an effective light emission control pulse (In FIG. 6, the effective light emission control pulse is exemplarily set to a low level, similarly in the following drawings), and green subpixels emit light; the light emission control signal lines corresponding to the rows of red subpixels and the light emission control signal lines corresponding to the rows of blue subpixels transmit an ineffective light emission control pulse (In FIG. 6, the ineffective light emission control pulse is exemplarily set to a high level, similarly in the following drawings), and the rows of red subpixels and the rows of blue subpixels do not emit light. Moreover, the reset control signal lines corresponding to the rows of red subpixels and the reset control signal lines corresponding to the rows of blue subpixels transmit an effective reset pulse, and the anodes of the light-emitting elements of the rows of red subpixels and the anodes of the light-emitting elements of the rows of blue subpixels are at a reset voltage.

On the basis of the above embodiments, optionally, the display period of each frame of image T includes a data writing stage A1 and a light emission control stage A2. In the data writing stage A1 of the display period of each frame of image T, each row of pixel units sequentially performs data writing. After the data writing stage A1 of the display period of each frame of image T ends, the light emission control stage A2 is performed, and in the light emission control stage A2, the subpixels with the same color emit light simultaneously, and the subpixels with different colors emit light sequentially. For example, referring to FIG. 6, in the data writing stage A1 of the display period of each frame of image T, data writing is performed by full screen scanning first. In FIG. 6, $Scan_{RX}$ refers to a scan signal corresponding to red subpixels in the X-th row of pixel units, $Scan_{GX}$ refers to a scan signal corresponding to green subpixels in the X-th row of pixel units, $Scan_{RX}$ refers to a scan signal corresponding to blue subpixels in the X-th row of pixel units, and X is a positive integer.

Figure 7:
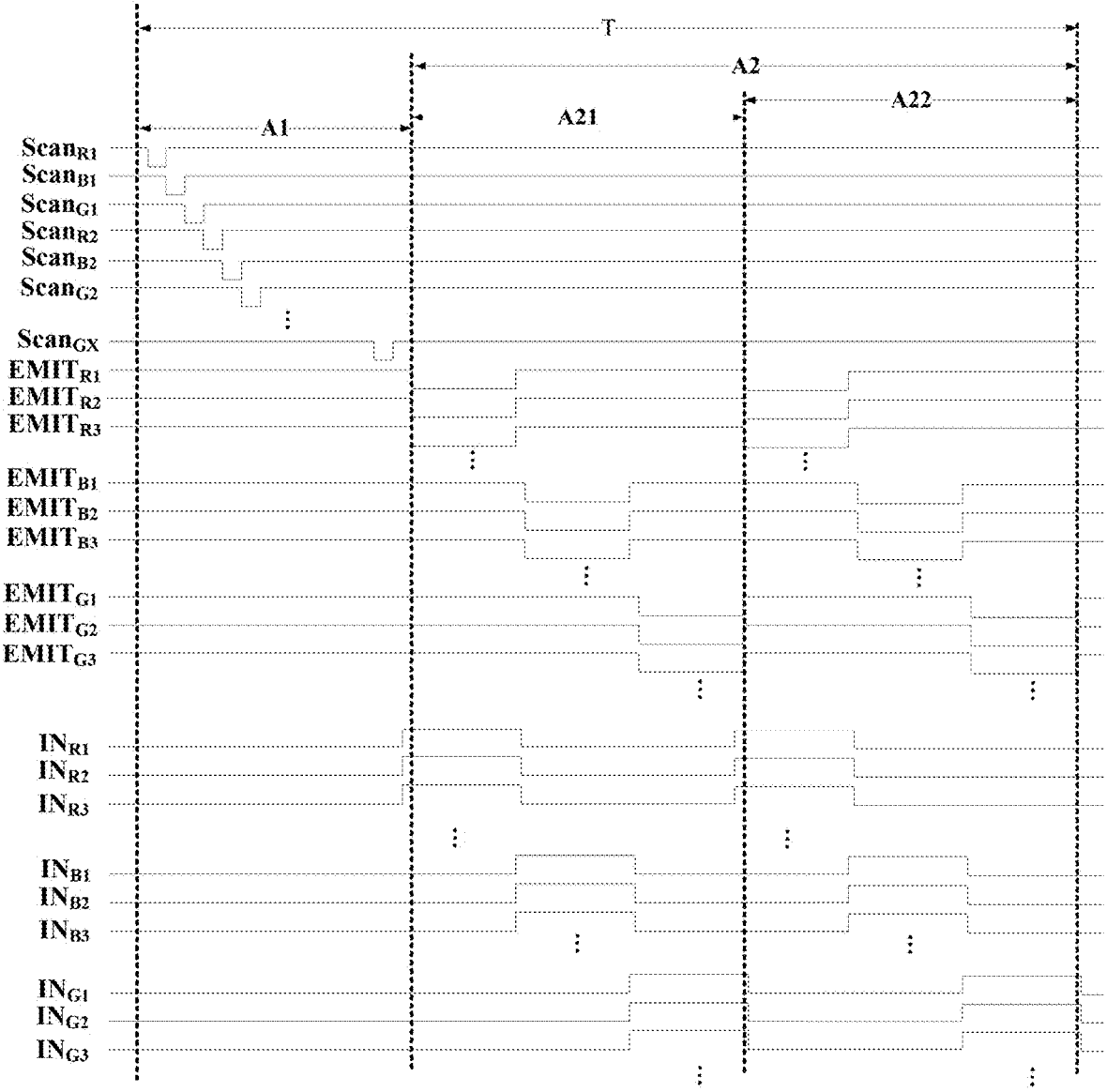
FIG. 7 is a driving timing diagram of another organic light-emitting display panel according to an embodiment of the present application.

Optionally, the light emission control stage A2 of the display period of each frame of image may be set to include multiple light emission control substages. In each of the multiple light emission control substages, the subpixels with the same color emit light simultaneously, and the subpixels with different colors emit light sequentially. FIG. 7 is a driving timing diagram of another organic light-emitting display panel according to an embodiment of the present application. Referring to FIG. 7, exemplarily, the light emission control stage A2 of the display period of each frame of image includes two light emission control substages, that is, a light emission control substage A21 and a light emission control substage A22, respectively. In each light emission control substage, all red subpixels emit light simultaneously, all blue subpixels emit light simultaneously, and all green subpixels emit light simultaneously. In a same light emission control substage, the order of light emission of subpixels with various colors is from red subpixels to blue subpixels and to green subpixels.

Figure 8:
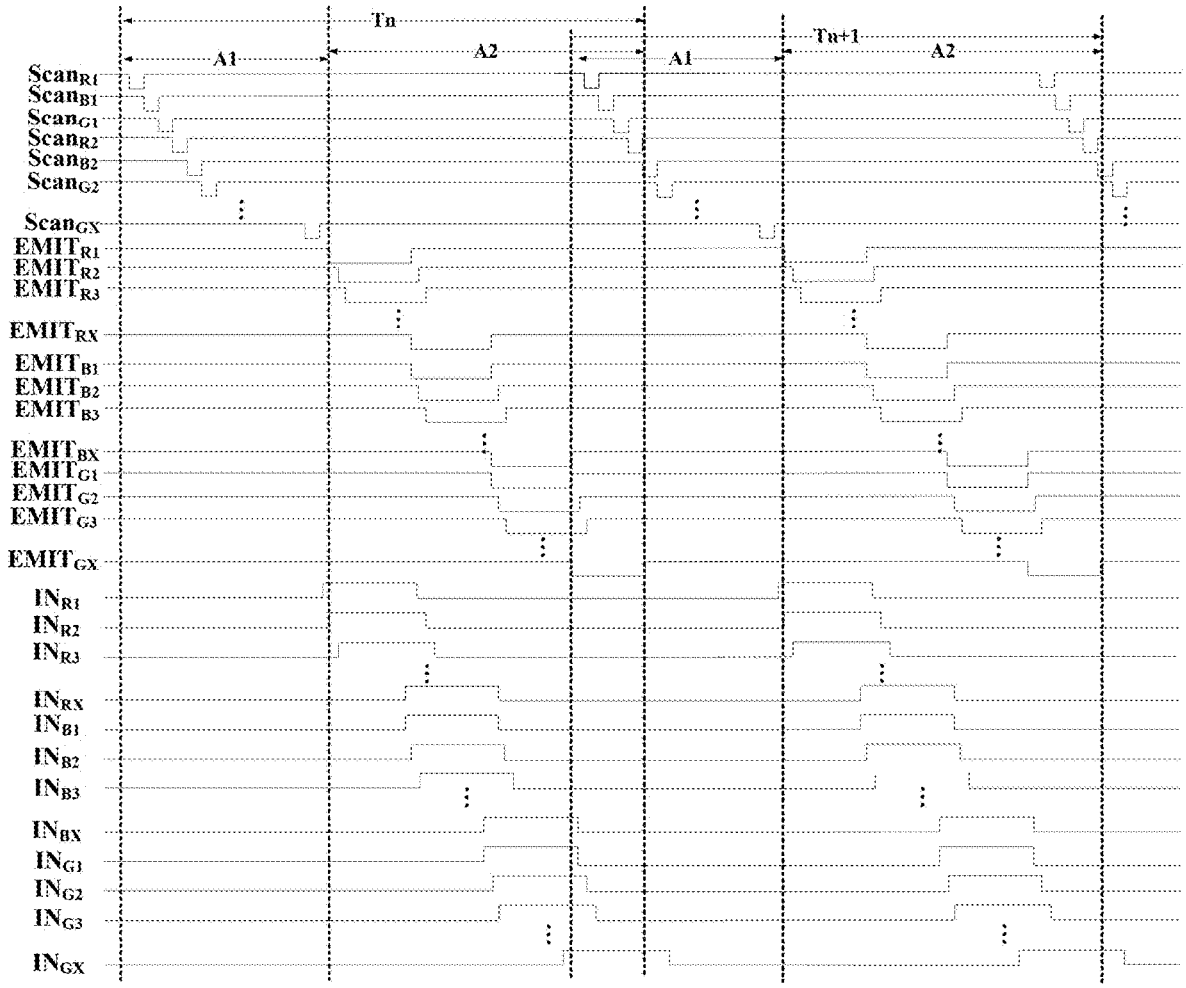
FIG. 8 is a driving timing diagram of another organic light-emitting display panel according to an embodiment of the present application.

FIG. 8 is a driving timing diagram of another organic light-emitting display panel according to an embodiment of the present application. In the organic light-emitting display panel provided by the embodiment of the present application, subpixels with a same color and connected to different light emission control signal lines emit light row by row, and light emission stages of adjacent two rows of subpixels with a same color overlap. An example is illustrated in which each pixel unit includes a red subpixel, a green subpixel and a blue subpixel. In FIG. 8, red subpixels emit light row by row, green subpixels emit light row by row, and blue subpixels emit light row by row. Light emission stages of adjacent two rows of red subpixels overlap, light emission stages of adjacent two rows of blue subpixels overlap, and light emission stages of adjacent two rows of green subpixels overlap.

Optionally, on the basis of the above embodiments, the display period of each frame of image includes a data writing stage A1 and a light emission control stage A2. In the data writing stage A1 of the display period of each frame of image, each row of pixel units sequentially performs data writing; and in the light emission control stage A2, the subpixels with the same color and connected to different light emission control signal lines emit light row by row, and the light emission stages of the adjacent two rows of subpixels with the same color overlap. For example, referring to FIG. 8, according to the driving manner provided by the embodiment of the present application, in the data writing stage A1 of the display period of each frame of image, data writing may be performed by full screen scanning first; and then in the light emission control stage A2, the subpixels with the same color and connected to different light emission control signals emit light row by row, and the light emission stages of the adjacent two rows of subpixels with the same color overlap.

Optionally, in the embodiment of the present application, it may be controlled that a light emission control stage of a previous frame of image display period overlaps a data writing stage of a next frame of image display period. For example, referring to FIG. 8, the light emission control stage A2 of a previous fame of image display period Tn overlaps the data writing stage A1 of a next frame of image display period Tn+1. As shown in FIG. 8, in the light emission control stage, rows of red subpixels are driven to emit light row by row, rows of blue subpixels are driven to emit light row by row, rows of green subpixels are driven to emit light row by row, and the light emission of the subpixels which emit light last (green subpixels in FIG. 8) continues until the next frame. Since the light emission stage of the green subpixels overlaps the data writing stage of the next frame, the scanning input of light emission control signals of the next frame is not affected.

Optionally, the light emission control stage of the display period of each frame of image includes multiple light emission control substages. In each of the multiple light emission control substages, the subpixels with the same color and connected to different light emission control signal lines emit light row by row, and the light emission stages of the adjacent two rows of subpixels with the same color overlap. For example, in FIG. 8, each light emission control stage A2 is set to include multiple light emission control substages. In each light emission control substage, the rows of red subpixels emit light row by row, the rows of green subpixels emit light row by row, and the rows of blue subpixels emit light row by row. Light emission stages of adjacent two rows of red subpixels overlap, light emission stages of adjacent two rows of blue subpixels overlap, and light emission stages of adjacent two rows of green subpixels overlap.

Figure 9:
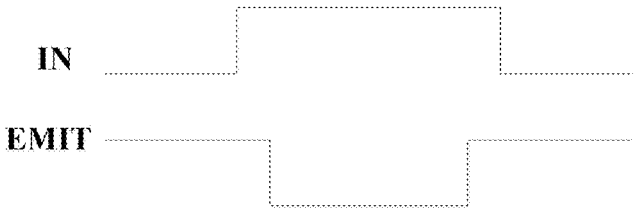
FIG. 9 is a driving timing diagram of a light emission control signal line and a reset control signal line of a same subpixel.

On the basis of the above embodiments, optionally, a light emission control signal line and a reset control signal line connected to a same subpixel satisfy that: an effective light emission control pulse of the light emission control signal line does not overlap an effective reset pulse of the reset control signal line. FIG. 9 is a driving timing diagram of a light emission control signal line and a reset control signal line of a same subpixel. As shown in FIG. 9, an effective light emission control pulse (exemplarily a low level in FIG. 9) of the light emission control signal line EMIT does not overlap an effective reset pulse (exemplarily a low level in FIG. 9) of the reset control signal line IN. That is, the effective reset pulse of the reset control signal line IN should be cut off first, and then the effective light emission control pulse of the light emission control signal line EMIT is controlled to input; after the effective light emission control pulse of the light emission control signal line EMIT is cut off, the effective reset pulse of the reset control signal line IN is input. In this manner, the effective reset pulse of the reset control signal line IN is prevented from overlapping the effective light emission control pulse of the light emission control signal line EMIT so that a short circuit between a reset signal input terminal and a power signal terminal on the organic light-emitting display panel and the generation of a large current are avoided.

It should be noted that the specific circuit structure of the pixel-driving circuit of the organic light-emitting display panel is not limited in the embodiments of the present application, and several pixel-driving circuit structures that can achieve the beneficial effects of the present application are exemplarily provided below, but are not intended to limit the embodiments of the present application.

Figure 10:
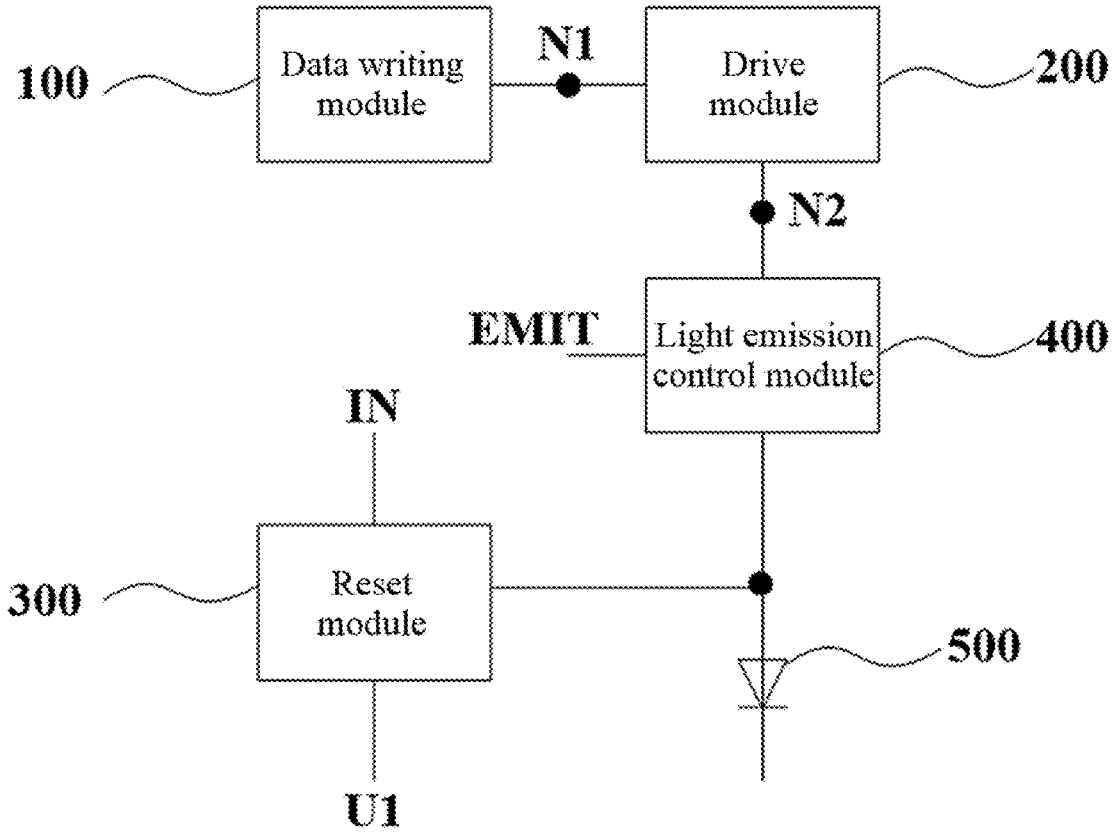
FIG. 10 is a structural diagram of a pixel-driving circuit according to an embodiment of the present application.

On the basis of the above embodiments, optionally, referring to FIG. 10, the pixel-driving circuit includes a data writing module 100, a drive module 200, a reset module 300 and a light emission control module 400.

The data writing module 100 and the drive module 200 are electrically connected to a first node N1; the drive module 200 and the light emission control module 400 are electrically connected to a second node N2; the reset module 300 and the light emission control module 400 are each electrically connected to an anode of the light-emitting element 500; the reset module 300 is electrically connected to a reset control signal line IN; and the light-emitting control module 400 is electrically connected to a light emission control signal line EMIT. The data writing module 100 is configured to provide a data signal to the first node N1; the drive module 200 is configured to drive the light-emitting element 500 to emit light in a case where the light emission control module 400 is turned on; and the reset module 300 is configured to provide a reset signal U1 to the anode of the light-emitting element when an effective reset pulse is input into the reset control signal line IN to enable the anode of the light-emitting element to be at a reset voltage U1 (for ease of description, the same reference numeral is used for representing the reset signal and the reset voltage).

Optionally, the light emission control module 400 includes a first transistor T1; the reset module 300 includes a second transistor T2; the first transistor T1 is an NMOS transistor, and the second transistor T2 is a PMOS transistor; or the second transistor T2 is an NMOS transistor, and the first transistor T1 is a PMOS transistor; and a light emission control signal line EMIT of a subpixel is further used as a reset control signal line IN of the subpixel.

Figure 11:
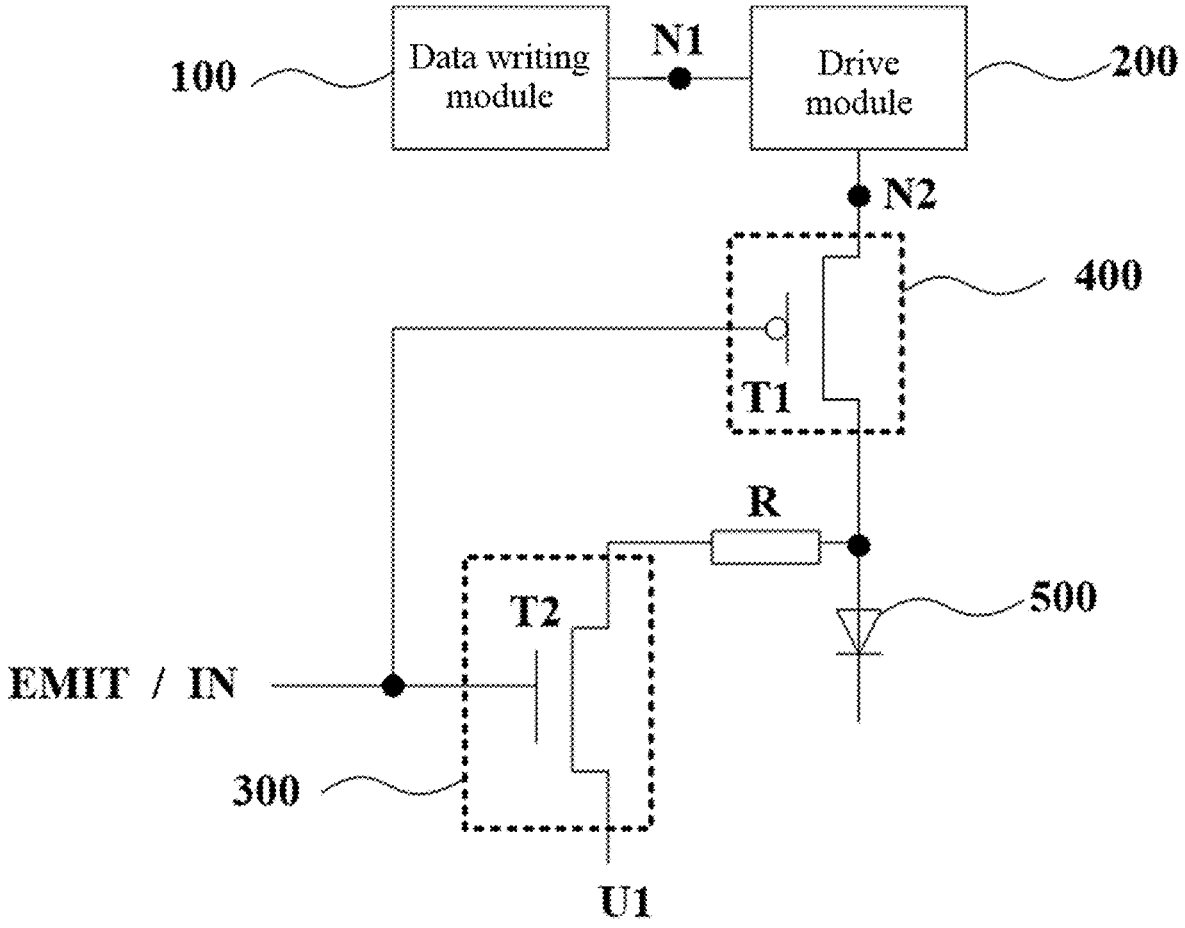
FIG. 11 is a structural diagram of another pixel-driving circuit according to an embodiment of the present application.

Referring to FIG. 11, the first transistor T1 is a PMOS transistor, the second transistor T2 is an NMOS transistor, and the first transistor T1 and the second transistor T2 uses a same signal line, that is, the light emission control signal line EMIT of a subpixel is also used as the reset control signal line IN of the subpixel. In this way, the number of signal lines in the pixel-driving circuit can be reduced, and the number of scan driver circuits in the organic light-emitting display panel can be reduced. For example, the scanning input of the light emission control signal and the scanning input of the reset control signal may be performed by a same scan driver circuit.

Figure 12:
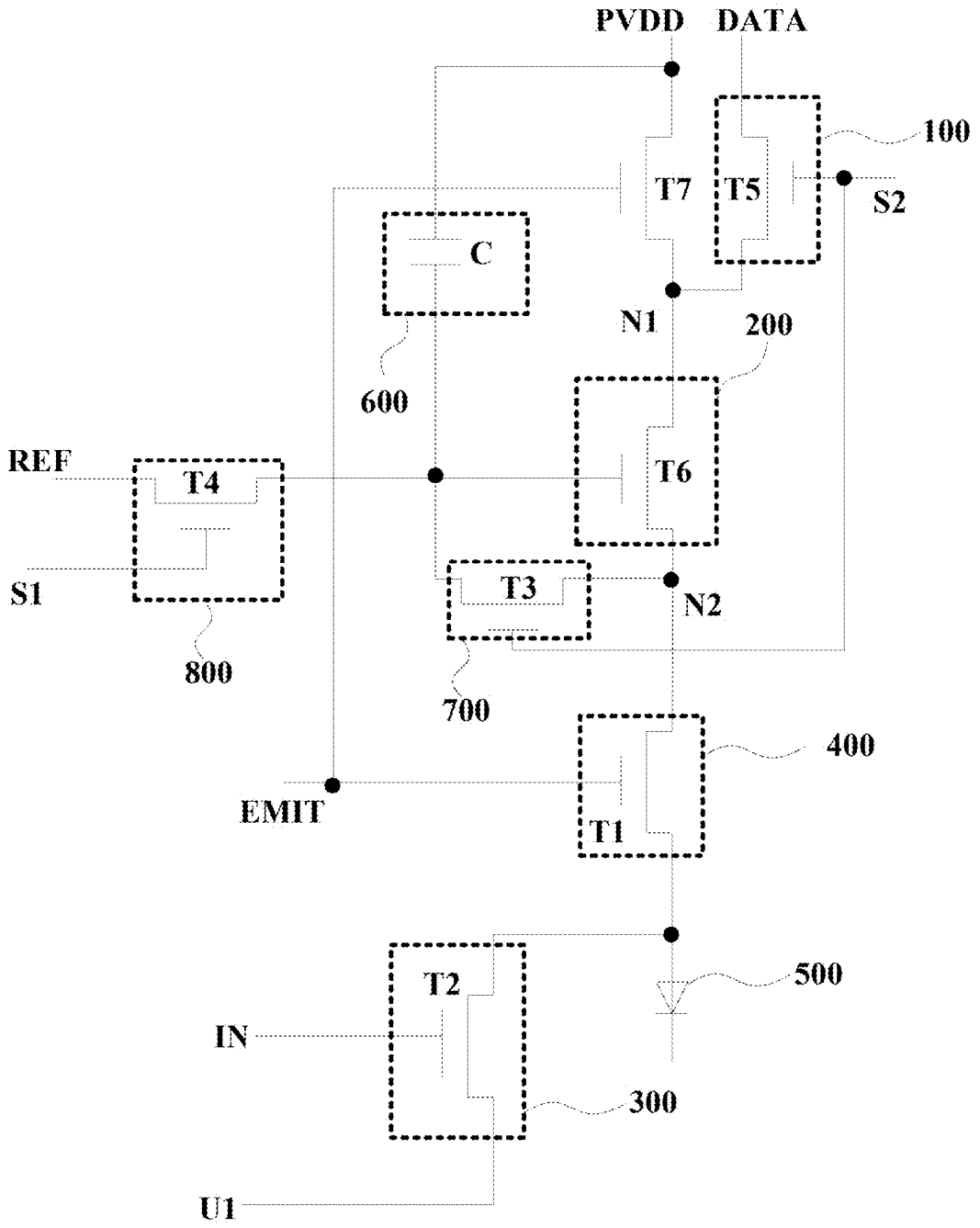
FIG. 12 is a structural diagram of another pixel-driving circuit according to an embodiment of the present application.

On the basis of the above embodiments, optionally, a current limiting resistor R may be connected in series between the light emission control module 400 and the reset module 300, so as to prevent a large current from being generated between the first transistor T1 and the second transistor T2 at the moment of switching. FIG. 12 is a structural diagram of another pixel-driving circuit according to an embodiment of the present application. As shown in FIG. 12, the pixel-driving circuit may further include a storage module 600, a threshold compensation module 700 and an initialization module 800. The storage module 600 includes a storage capacitor C, the threshold compensation module 700 includes a third transistor T3, and the initialization module 800 includes a fourth transistor T4. The data writing module 100 includes a fifth transistor T5, and the drive module 200 includes a sixth transistor T6. The pixel-driving circuit further includes a seventh transistor T7.

A control terminal of the third transistor T3 is electrically connected to a control terminal of the fifth transistor T5, a first electrode of the third transistor T3 is electrically connected to a first electrode plate of the capacitor C, a second electrode of the third transistor T3 and a second electrode of the sixth transistor T6 are both electrically connected to the second node N2, a first electrode of the sixth transistor T6 is electrically connected to the first node N1, a control terminal of the sixth transistor T6 is electrically connected to a second electrode of the fourth transistor T4, and a first electrode of the fourth transistor T4 is electrically connected to an initialization signal terminal REF. A second electrode plate of the capacitor C and a first electrode of the seventh transistor T7 are both electrically connected to a power signal terminal PVDD, a second electrode of the seventh transistor T7 and a second electrode of the fifth transistor T5 are both electrically connected to the first node N1, and a first electrode of the fifth transistor T5 is electrically connected to a data signal terminal DATA. A control terminal of the first transistor T1 and a control terminal of the seventh transistor T7 are both electrically connected to a light emission control signal terminal (into which a light emission control signal EMIT is input), a first electrode of the first transistor T1 is electrically connected to the second node N2, a second electrode of the first transistor T1 and a first electrode of the second transistor T2 are both electrically connected to the anode of the light-emitting element 500, a second electrode of the second transistor T2 is electrically connected to a reset signal input terminal (into which the reset signal U1 is input), and a control terminal of the second transistor T2 is electrically connected to a reset control signal terminal (into which a reset control signal IN is input).

Optionally, the first electrode of the fourth transistor T4 may be electrically connected to the second electrode of the second transistor T2, that is, the initialization signal terminal is used as the reset signal input terminal. The reset signal U1 input into the reset signal input terminal is equivalent to an initialization potential REF for the initialization of the drive module.

It should be noted that the signal input into the reset signal input terminal may further be a zero potential, a ground potential GND, a cathode potential of the light-emitting element, a common negative potential VSS lower than the cathode potential of the light-emitting element or a common low potential VGL used by other circuits in the organic light-emitting display panel.

Figure 13:
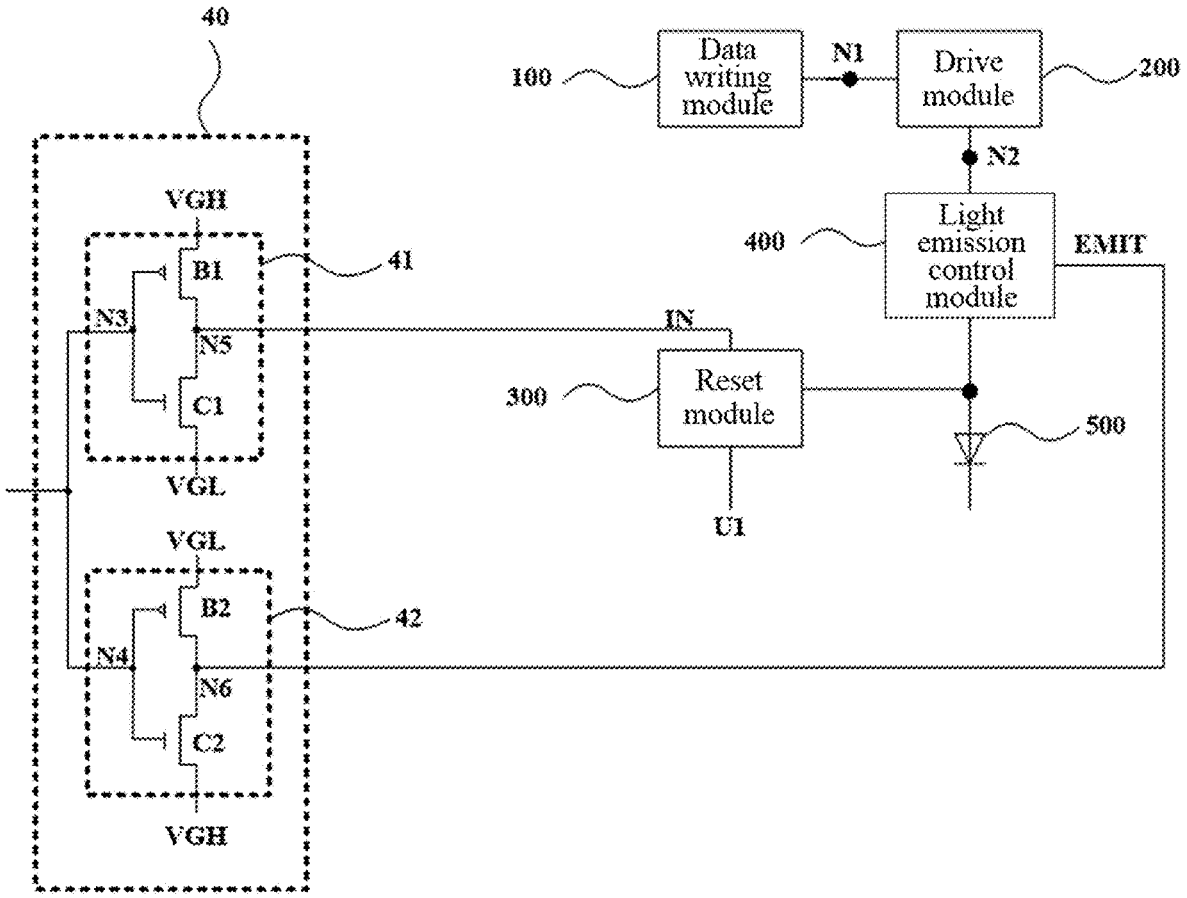
FIG. 13 is a partial structural diagram of another organic light-emitting display panel according to an embodiment of the present application.

FIG. 13 is a partial structural diagram of another organic light-emitting display panel according to an embodiment of the present application. As shown in FIG. 13, the organic light-emitting display panel provided by the embodiment of the present application further includes multiple inverter groups 40, where each of the multiple inverter groups 40 includes a first inverter 41 and a first non-inverter 42.

The first inverter 41 includes a first PMOS transistor B1 and a first NMOS transistor C1; and the first non-inverter 42 includes a second PMOS transistor B2 and a second NMOS transistor C2.

A control terminal of the first PMOS transistor B1 and a control terminal of the first NMOS transistor C1 are electrically connected to a third node N3; a control terminal of the second PMOS transistor B2 and a control terminal of the second NMOS transistor C2 are each electrically connected to a fourth node N4; and the third node N3 is electrically connected to the fourth node N4.

A first electrode of the first PMOS transistor B1 and a second electrode of the second NMOS transistor C2 are each electrically connected to a high-level signal terminal VGH; and a second electrode of the first PMOS transistor B1 and a first electrode of the first NMOS transistor C1 are electrically connected to a fifth node N5.

A second electrode of the first NMOS transistor C1 and a first electrode of the second PMOS transistor B2 are each electrically connected to a low-level signal terminal VGL; and a second electrode of the second PMOS transistor B2 and a first electrode of the second NMOS transistor C2 are electrically connected to a sixth node N6.

The fifth node N5 is further electrically connected to a reset control signal line IN corresponding to subpixels having a same timing in a light emission stage.

The sixth node N6 is further electrically connected to a light emission control signal line EMIT corresponding to the subpixels having the same timing in the light emission stage.

In the embodiment of the present application, the inverter groups are provided, so that the reset control signal and the light emission control signal may be generated by a same gate driver circuit. As shown in FIG. 13, the inverter group 40 may generate both the reset control signal IN and the light emission control signal EMIT. For ease of description herein, the reset control signal line and the reset control signal are both marked as IN, and the light emission control signal line and the light emission control signal are both marked as EMIT.

On the basis of the above embodiments, optionally, a width-to-length ratio $$\frac{W}{L_{B1}}$$

of me first PMOS transistor B1 is set to be greater than a width-to-length ratio $$\frac{W}{L_{C2}}$$

of the second NMOS transistor C2; and a width-to-length ratio $$\frac{W}{L_{C1}}$$

of the first NMOS transistor C1 is less than a width-to-length ratio $$\frac{W}{L_{B2}}$$

of the second PMOS transistor B2.

$$\frac{W}{L_{B1}} > \frac{W}{L_{C2}}; \frac{W}{L_{C1}} > \frac{W}{L_{B2}}.$$

In the embodiment of the present application, width-to-length ratios of MOS transistors in the inverter group are adjusted, so that a certain delay exists between the generated reset control signal and light emission control signal, that is, an output delay of the first inverter 41 is different from an output delay of the first non-inverter 42 and a driving timing shown in FIG. 9 is generated. In this way, a short circuit between the reset signal input terminal and the power signal terminal on the organic light-emitting display panel is prevented, and the generation of a large current is avoided.

Figure 14:
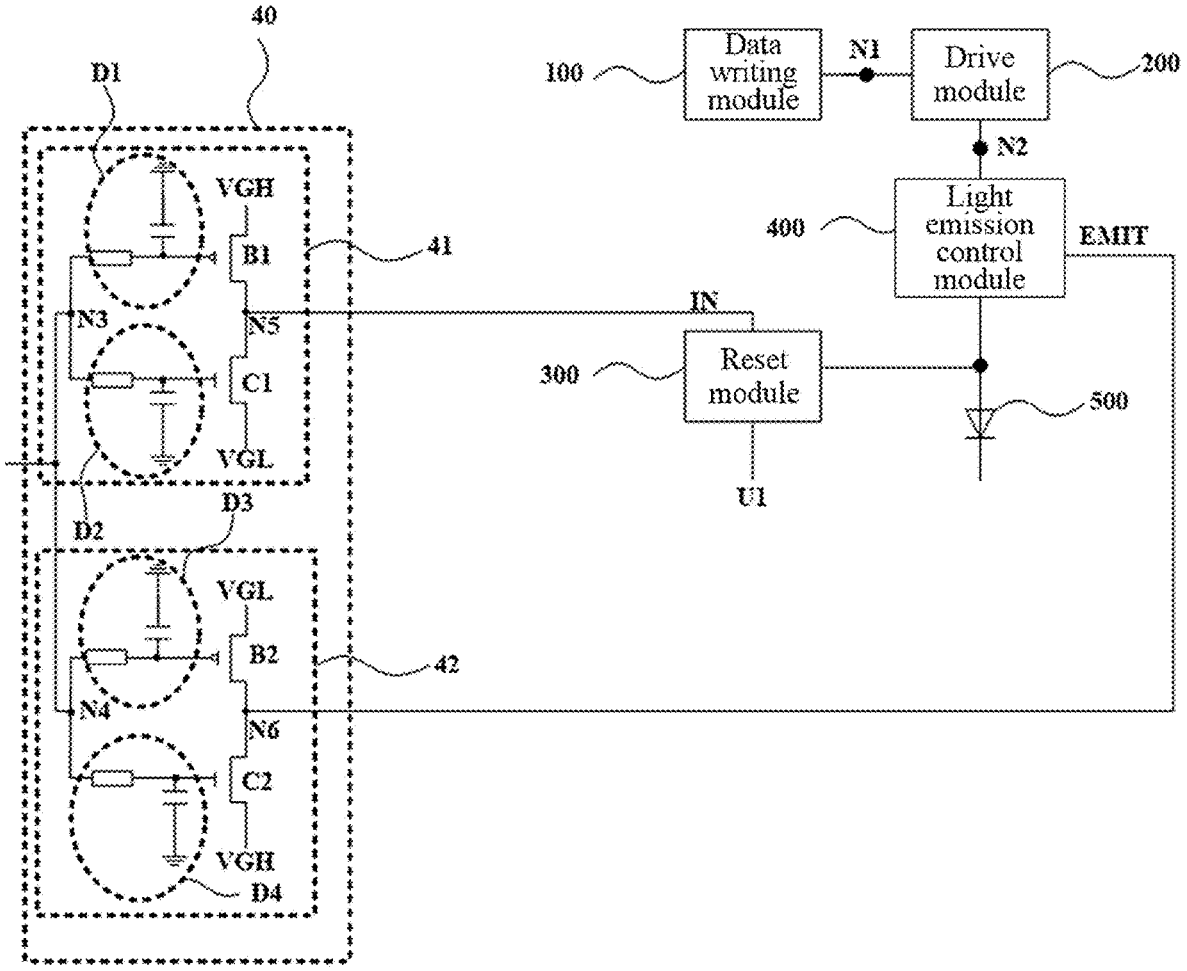
FIG. 14 is a partial structural diagram of another organic light-emitting display panel according to an embodiment of the present application.

Optionally, to make the output delay of the first inverter 41 is different from the output delay of the first non-inverter 42, as shown in FIG. 14, each inverter group may further be set to include a first resistor—capacitor (RC) circuit D1, a second RC circuit D2, a third RC circuit D3 and a fourth RC circuit D4.

The first RC circuit D1 is electrically connected between the control terminal of the first PMOS transistor B1 and the third node N3, and the second RC circuit D2 is electrically connected between the control terminal of the first NMOS transistor C1 and the third node N3. The third RC circuit D3 is electrically connected between the control terminal of the second PMOS transistor B2 and the fourth node N4, and the fourth RC circuit D4 is electrically connected between the control terminal of the second NMOS transistor C2 and the fourth node N4. A time constant $\tau_{D1}$ of the first RC circuit D1 is less than a time constant $\tau_{D3}$ of the third RC circuit D3; and a time constant $\tau_{D2}$ of the second RC circuit D2 is greater than a time constant $\tau_{D4}$ of the fourth RC circuit D4.

$$\tau_{D1}<\tau_{D3};\tau_{D2}>\tau_{D4}.$$

The first RC circuit D1, the second RC circuit D2, the third RC circuit D3 and the fourth RC circuit D are adjusted to satisfy the above time constant relationship, so that the output delay of the first inverter 41 is different from the output delay of the first non-inverter 42.

Figure 15:
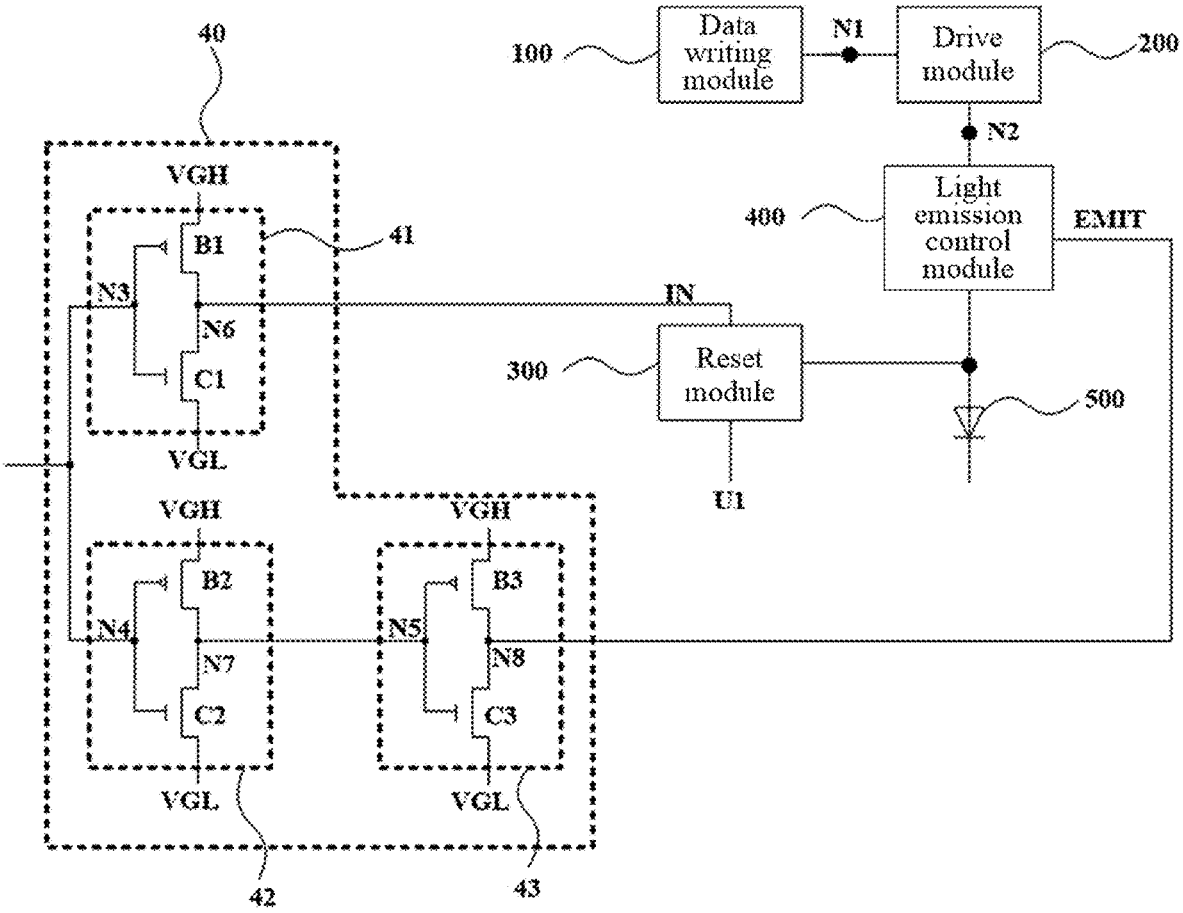
FIG. 15 is a partial structural diagram of another organic light-emitting display panel according to an embodiment of the present application.

Optionally, the embodiment of the present application further provides a partial structural diagram of an organic light-emitting display panel. As shown in FIG. 15, the organic light-emitting display panel provided by the embodiment of the present application further includes multiple inverter groups 40, where each of the multiple inverter groups 40 includes a first inverter 41, a second inverter 42 and a third inverter 43.

The first inverter 41 includes a first PMOS transistor B1 and a first NMOS transistor C1, the second inverter 42 includes a second PMOS transistor B2 and a second NMOS transistor C2, and the third inverter 43 includes a third PMOS transistor B3 and a third NMOS transistor C3. A control terminal of the first PMOS transistor B1 and a control terminal of the first NMOS transistor C1 are electrically connected to a third node N3, a control terminal of the second PMOS transistor B2 and a control terminal of the second NMOS transistor C2 are electrically connected to a fourth node N4, and a control terminal of the third PMOS transistor B3 and a control terminal of the third NMOS transistor C3 are electrically connected to a fifth node N5.

A first electrode of the first PMOS transistor B1, a first electrode of the second PMOS transistor B2 and a first electrode of the third PMOS transistor B3 are each electrically connected to a high-level signal terminal VGH. A second electrode of the first PMOS transistor B1 and a first electrode of the first NMOS transistor C1 are electrically connected to a sixth node N6. A second electrode of the first NMOS transistor C1, a second electrode of the second NMOS transistor C2 and a second electrode of the third NMOS transistor C3 are each electrically connected to a low-level signal terminal VGL. A second electrode of the second PMOS transistor B2 and a first electrode of the second NMOS transistor C2 are electrically connected to a seventh node N7. A second electrode of the third PMOS transistor B3 and a first electrode of the third NMOS transistor C3 are electrically connected to an eighth node N8. The third node N3 is electrically connected to the fourth node N4. The sixth node N6 is further electrically connected to a reset signal control line IN corresponding to subpixels having a same timing in a light emission stage. The seventh node N7 is electrically connected to the fifth node N5. The eighth node N8 is electrically connected to a light emission control signal line EMIT corresponding to the subpixels having the same timing in the light emission stage.

In the embodiment of the present application, one inverter outputs the reset control signal to the reset control signal line, and two inverters connected in series output the light emission control signal to the light emission control signal line, so that the timing of the reset control signal and the timing of the light emission control signal received by a same subpixel satisfies the requirements of the above embodiments.

Optionally, on the basis of the above embodiments, it may be set that a sum of a charging-and-discharging time constant $t_{B2}$ of the second PMOS transistor B2 and a charging-and-discharging time constant $t_{C3}$ of the third NMOS transistor C3 is greater than a charging-and-discharging time constant $t_{B1}$ of the first PMOS transistor B1; and a sum of a charging-and-discharging time constant $t_{C2}$ of the second NMOS transistor C2 and a charging-and-discharging time constant $t_{B3}$ of the third PMOS transistor B3 is less than a charging-and-discharging time constant $t_{C1}$ of the first NMOS transistor C1.

$$t_{B1}<t_{B2}+t_{C3};t_{C2}+t_{B3}<t_{C1}.$$

The charging-and-discharging time constants of the MOS transistors in the first inverter 41, the charging-and-discharging time constants of the MOS transistors in the second inverter 42 and the charging-and-discharging time constants of the MOS transistors in the third inverter 43 are adjusted to satisfy the above relationship, so that the timing delay of the light emission control signal is different from the timing delay of the reset control signal.

Figure 16:
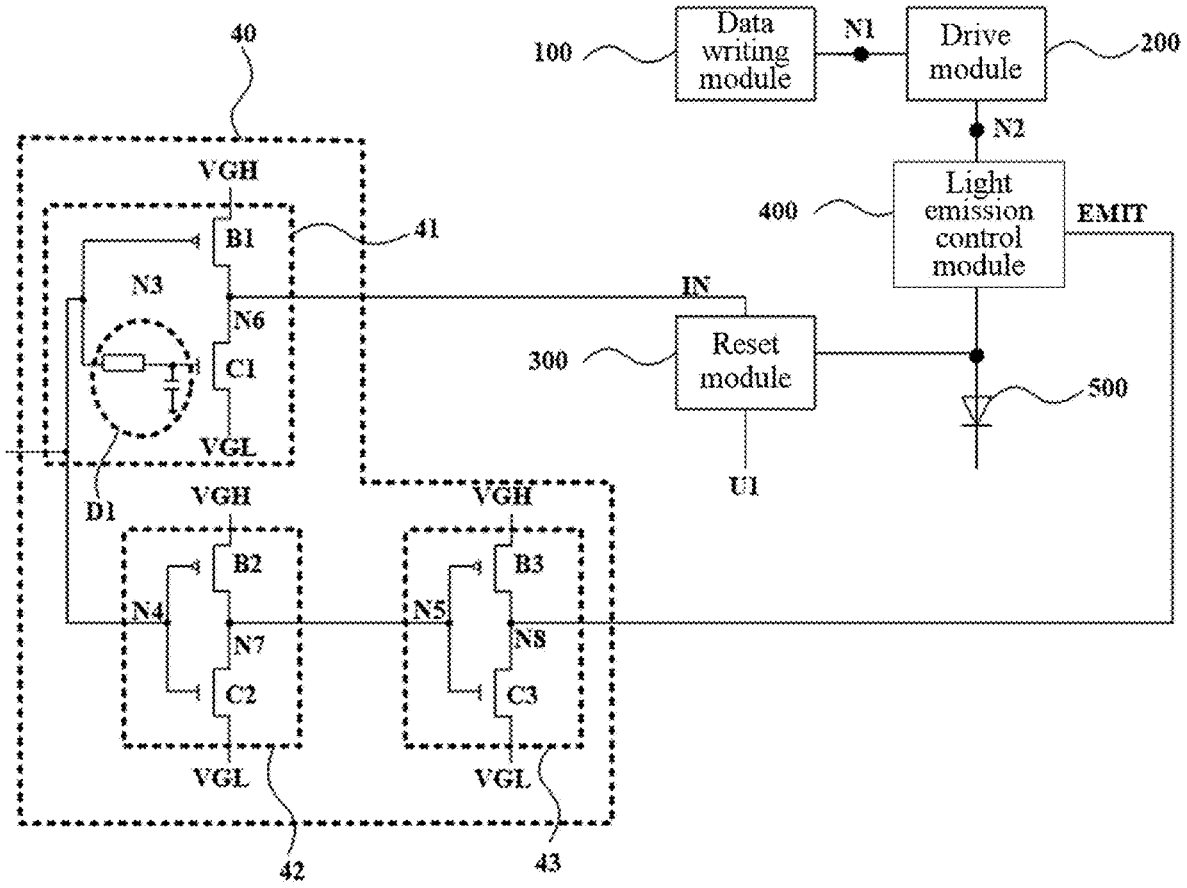
FIG. 16 is a partial structural diagram of another organic light-emitting display panel according to an embodiment of the present application.

Optionally, referring to FIG. 16, the each of the multiple inverter groups 40 may further include a first RC circuit D1, and the first RC circuit D1 is located between the third node N3 and the control terminal of the first NMOS transistor C1.

A sum of a charging-and-discharging time constant of the second PMOS transistor B2 and a charging-and-discharging time constant of the third NMOS transistor C3 is greater than a charging-and-discharging time constant of the first PMOS transistor B1; and a sum of a charging-and-discharging time constant of the second NMOS transistor C2 and a charging-and-discharging time constant of the third PMOS transistor B3 is less than a sum of a charging-and-discharging time constant of the first NMOS transistor C1 and a time constant of the first RC circuit D1.

$$t_{B1}<t_{B2}+t_{C3};t_{C2}+t_{B3}<t_{C1}+\tau_{D1}.$$

Based on the same inventive concept, the embodiment of the present application further provides a driving method of an organic light-emitting display panel. The method is applicable to the organic light-emitting display panel of any one of the above embodiments and includes steps described below.

In step S11, in at least part of a light emission stage of subpixels with an i-th color in a same row of pixel units, a potential of a light emission control signal line of the subpixels with the i-th color is controlled to be a first level, a potential of a light emission control signal line of subpixels with another color in the same row of pixel units is controlled to be a second level, a potential of a reset control signal line of the subpixels with the i-th color in the same row of pixel units is controlled to be a third level, and a potential of a reset control signal line of the subpixels with the another color in the same row of pixel units is controlled to be a fourth level, so that anodes of light-emitting elements of the subpixels with the another color in the same row of pixel units are at a reset voltage and the subpixels with the another color in the same row of pixel units are in a non-light-emission stage, and a leakage current generated through common layers by the subpixels with the i-th color is led out.

i is a positive integer; the first level is an effective light emission control pulse; the second level is an ineffective light emission control pulse; the third level is an ineffective reset control pulse; and the fourth level is an effective reset control pulse. Therefore, in at least part of a light emission stage of subpixels with an i-th color in a same row of pixel units, subpixels with another color in the same row of pixel units do not emit light, anodes of light-emitting elements of the subpixels with the another color are at a reset voltage, and thus the anodes are reset. If the subpixels with the i-th color which are emitting light generate a leakage current at adjacent subpixels with another color, the leakage current can be led out due to the reset voltage of anodes of light-emitting elements of the adjacent subpixels, so that crosstalk between subpixels with different colors can be avoided.

In step S12: in at least part of a light emission stage of subpixels with an (i+1)-th color in the same row of pixel units, a potential of a light emission control signal line of the subpixels with the (i+1)-th color is controlled to be the first level, a potential of a light emission control signal line of subpixels with another color in the same row of pixel units is controlled to be the second level, a potential of a reset control signal line of the subpixels with the (i+1)-th color in the same row of pixel units is controlled to be the third level, and a potential of a reset control signal line of the subpixels with the another color in the same row of pixel units is controlled to be the fourth level, so as to enable anodes of light-emitting elements of the subpixels with the another color in the same row of pixel units to be at a reset voltage and the subpixels with the another color in the same row of pixel units to be in a non-light-emission stage, so that a leakage current generated through common layers by the subpixels with the (i+1)-th color is led out.

Similarly, in at least part of a light emission stage of subpixels with an (i+1)-th color in a same row of pixel units, subpixels with another color in the same row of pixel units do not emit light, anodes of light-emitting elements of the subpixels with the another color are at a reset voltage, and thus the anodes are reset. If the subpixels with the (i+1)-th color which are emitting light generate a leakage current to adjacent subpixels with another color, the leakage current can be led out due to the reset voltage of anodes of light-emitting elements of the adjacent subpixels, so that crosstalk between subpixels with different colors can be avoided.

Step S11 and step S12 are circularly executed until subpixels with all colors in the same row of pixel units sequentially complete light emission.

The arrangement of subpixels in the organic light-emitting display panel in FIG. 1 is taken as an example.

First, in at least part of a light emission stage of red subpixels R in a same row of pixel units, the potential of the light emission control signal line of the red subpixels R is controlled to be a first level, the potential of the light emission control signal line of subpixels with another color (blue subpixels B and green subpixels G) in the same row of pixel units is controlled to be a second level, the potential of the reset control signal line of the red subpixels R is controlled to be a third level, and the potential of the reset control signal line of the subpixels with the another color (the blue subpixels B and the green subpixels G) in the same row of pixel units is controlled to be a fourth level. In this way, anodes of light-emitting elements of the blue subpixels B and anodes of light-emitting elements of the green subpixels G are at a reset voltage and are in a non-light-emission stage.

Second, in at least part of a light emission stage of the blue subpixels B in the same row of pixel units, the potential of the light emission control signal line of the blue subpixels B is controlled to be the first level, the potential of the light emission control signal line of subpixels with another color (the red subpixels R and the green subpixels G) in the same row of pixel units is controlled to be the second level, the potential of the reset control signal line of the blue subpixels B is controlled to be the third level, and the potential of the reset control signal line of the subpixels with the another color (the red subpixels R and the green subpixels G) in the same row of pixel units is controlled to be the fourth level. In this way, anodes of light-emitting elements of the red subpixels R and the anodes of the light-emitting elements of the green subpixels G are at a reset voltage and are in a non-light-emission stage.

Third, in at least part of a light emission stage of the green subpixels G in the same row of pixel units, the potential of the light emission control signal line of the green subpixels G is controlled to be the first level, the potential of the light emission control signal line of subpixels with another color (the red subpixels R and the blue subpixels B) in the same row of pixel units is controlled to be the second level, the potential of the reset control signal line of the green subpixels G is controlled to be the third level, and the potential of the reset control signal line of the subpixels with the another color (the red subpixels R and the blue subpixels B) in the same row of pixel units is controlled to be the fourth level. In this way, the anodes of the light-emitting elements of the red subpixels R and the anodes of the light-emitting elements of the blue subpixels B are at a reset voltage and are in a non-light-emission stage.

According to the above driving method, subpixels with various colors in the same row of pixel units emit light sequentially.

Optionally, in the embodiment of the present application, in display period of each frame of image, light emission stages of subpixels with different colors in a same row of pixel units may be controlled not to overlap. That is, in an entire light emission stage of subpixels with an i-th color in a same row of pixel units, the potential of the light emission control signal line of the subpixels with the i-th color is controlled to be a first level, the potential of the light emission control signal line of subpixels with another color in the same row of pixel units is controlled to be a second level, the potential of the reset control signal line of the subpixels with the i-th color is controlled to be a third level, and the potential of the reset control signal line of the subpixels with the another color in the same row of pixel units is controlled to be a fourth level, so that crosstalk between subpixels with different colors can be avoided in the entire light emission stage of subpixels with each color.

Optionally, in the display period of each frame of image, it may be controlled that subpixels with a same color emit light simultaneously, and subpixels with different colors emit light sequentially. For example, the organic light-emitting display panel is driven to emit light according to the driving timing shown in FIG. 6.

Optionally, in the embodiment of the present application, it may further be controlled that subpixels with a same color and connected to different light emission control signal lines emit light row by row, and light emission stages of adjacent two rows of subpixels with a same color overlap. For example, the organic light-emitting display panel is driven to emit light according to the driving timing shown in FIG. 8.

Optionally, according to the driving method provided by the embodiment of the present application, it may be controlled that the display period of each frame of image includes a data writing stage and a light emission control stage. In the data writing stage of the display period of each frame of image, each row of pixel units sequentially performs data writing; and after the data writing stage of the display period of each frame of image ends, the light emission control stage is performed. In the light emission control stage, subpixels with a same color emit light simultaneously, and subpixels with different colors emit light sequentially.

Alternatively, the display period of each frame of image includes a data writing stage and a light emission control stage. In the data writing stage of the display period of each frame of image, each row of pixel units sequentially performs data writing; and in the light emission control stage, subpixels with a same color and connected to different light emission control signal lines emit light row by row, and light emission stages of adjacent two rows of subpixels with a same color overlap.

Optionally, it may further be controlled that a light emission control stage of a previous frame of image display period overlaps a data writing stage of a next frame of image display period.

Optionally, it may further be set that the light emission control stage in the display period of each frame of image includes multiple light emission control substages. In each light emission control substage, subpixels with a same color emit light simultaneously, and subpixels with different colors emit light sequentially; or, in each light emission control substage, subpixels with a same color and connected to different light emission control signal lines emit light row by row, and light emission stages of adjacent two rows of subpixels with a same color overlap.

On the basis of the above embodiments, optionally, a light emission control signal line and a reset control signal line connected to a same subpixel satisfy that: an effective light emission control pulse of the light emission control signal line does not overlap an effective reset pulse of the reset control signal line. In this way, a short circuit between a reset signal input terminal and a power signal terminal on the organic light-emitting display panel is prevented, and the generation of a large current is avoided.

What is claimed is:

1. An organic light-emitting display panel, comprising a plurality of pixel units, wherein each of the plurality of pixel units comprises a plurality of subpixels with different colors;

each of the plurality of subpixels comprises a pixel-driving circuit and a light-emitting element electrically connected to the pixel-driving circuit; the light-emitting element comprises a common layer; and common layers of adjacent light-emitting elements are disposed in a same layer and connected to each other;

pixel-driving circuits of subpixels with a same color in a same row are connected to a same light emission control signal line; and in a case where the light emission control signal line transmits an effective light emission control pulse, the subpixels to which the pixel-driving circuits electrically connected to the light emission control signal line belong are in a light emission stage;

the pixel-driving circuits of the subpixels with the same color in the same row are connected to a same reset control signal line; and in a case where the reset control signal line transmits an effective reset pulse, anodes of light-emitting elements of the subpixels to which the pixel-driving circuits electrically connected to the reset control signal line belong are at a reset voltage, and the subpixels to which the pixel-driving circuits electrically connected to the reset control signal line belong are in a non-light-emission stage;

pixel-driving circuits of subpixels with different colors in a same row of pixel units are connected to different light emission control signal lines; and the pixel-driving circuits of the subpixels with different colors in the same row of pixel units are connected to different reset control signal lines;

in a display period of each frame of image, in at least part of a time period during which subpixels with an i-th color in a same row of pixel units are in a light emission stage, anodes of light-emitting elements of subpixels with another color in the same row of pixel units are at a reset voltage to lead out a leakage current, wherein the leakage current is generated through the common layers by the subpixels with the i-th color, and i is a positive integer; and in the display period of each frame of image, light emission stages of subpixels with different colors in a same row of pixel units do not overlap.

2. The organic light-emitting display panel according to claim 1, further comprising a plurality of first scan driver circuits and a plurality of second scan driver circuits, wherein each of the plurality of first scan driver circuits is electrically connected to light emission control signal lines corresponding to rows of subpixels with a same color; different first scan driver circuits of the plurality of first scan driver circuits are connected to light emission control signal lines corresponding to subpixels with different colors; each of the plurality of second scan driver circuits is electrically connected to reset control signal lines corresponding to the rows of subpixels with the same color; and different second scan driver circuits of the plurality of second scan driver circuits are connected to reset control signal lines corresponding to the subpixels with different colors;

the each of the plurality of first scan driver circuits comprises a plurality of cascaded first shift registers; and the each of the plurality of second scan driver circuits comprises a plurality of cascaded second shift registers;

at least two adjacent light emission control signal lines connected to pixel-driving circuits of subpixels with a same color composes a light emission control signal line group; and each light emission control signal line in the light emission control signal line group is connected to a same first shift register of the plurality of cascaded first shift registers; and at least two adjacent reset control signal lines connected to the pixel-driving circuits of the subpixels with the same color composes a reset control signal line group; and each reset control signal line in the reset control signal line group is connected to a same second shift register of the plurality of cascaded second shift registers.

3. The organic light-emitting display panel according to claim 1, further comprising a plurality of first scan driver circuits and a plurality of second scan driver circuits, wherein each of the plurality of first scan driver circuits is electrically connected to light emission control signal lines corresponding to rows of subpixels with a same color; different first scan driver circuits of the plurality of first scan driver circuits are connected to light emission control signal lines corresponding to subpixels with different colors; each of the plurality of second scan driver circuits is electrically connected to reset control signal lines corresponding to the rows of subpixels with the same color; and different second scan driver circuits of the plurality of second scan driver circuits are connected to reset control signal lines corresponding to the subpixels with different colors;

the each of the plurality of first scan driver circuits comprises a plurality of cascaded first shift registers; and the each of the plurality of second scan driver circuits comprises a plurality of cascaded second shift registers;

light emission control signal lines corresponding to rows of subpixels with a same color are electrically connected to a plurality of cascaded first shift registers of a same first scan driver circuit in a one-to-one correspondence; and reset control signal lines corresponding to the rows of subpixels with the same color are electrically connected to a plurality of cascaded second shift registers of a same second scan driver circuit in the one-to-one correspondence.

4. The organic light-emitting display panel according to claim 1, wherein light emission control signal lines corresponding to subpixels with a same color are electrically connected to each other; and reset control signal lines corresponding to the subpixels with the same color are electrically connected to each other; and in the display period of each frame of image, subpixels with a same color emit light simultaneously, and subpixels with different colors emit light sequentially.

5. The organic light-emitting display panel according to claim 4, wherein the display period of each frame of image comprises a data writing stage and a light emission control stage;

in the data writing stage of the display period of each frame of image, data writing is performed on a plurality of rows of pixel units sequentially; and after the data writing stage of the display period of each frame of image ends, the light emission control stage is entered; and in the light emission control stage, the subpixels with the same color emit light simultaneously, and the subpixels with different colors emit light sequentially.

6. The organic light-emitting display panel according to claim 5, wherein the light emission control stage of the display period of each frame of image comprises a plurality of light emission control substages; and in each of the plurality of light emission control substages, the subpixels with the same color emit light simultaneously, and the subpixels with different colors emit light sequentially.

7. The organic light-emitting display panel according to claim 1, wherein subpixels with a same color and connected to different light emission control signal lines emit light row by row, and light emission stages of adjacent two rows of subpixels with a same color overlap.

8. The organic light-emitting display panel according to claim 7, wherein the display period of each frame of image comprises a data writing stage and a light emission control stage;

in the data writing stage of the display period of each frame of image, data writing is performed on a plurality of rows of pixel units sequentially; and in the light emission control stage, the subpixels with the same color and connected to different light emission control signal lines emit light row by row, and the light emission stages of the adjacent two rows of subpixels with the same color overlap.

9. The organic light-emitting display panel according to claim 8, wherein a light emission control stage in a display period of a previous frame of image overlaps a data writing stage in a display period of a next frame of image.

10. The organic light-emitting display panel according to claim 8, wherein the light emission control stage of the display period of each frame of image comprises a plurality of light emission control substages; and in each of the plurality of light emission control substages, the subpixels with the same color and connected to different light emission control signal lines emit light row by row, and the light emission stages of the adjacent two rows of subpixels with the same color overlap.

11. The organic light-emitting display panel according to claim 1, wherein a light emission control signal line and a reset control signal line connected to a same subpixel satisfy that:

an effective light emission control pulse of the light emission control signal line does not overlap an effective reset pulse of the reset control signal line.

12. The organic light-emitting display panel according to claim 1, wherein the pixel-driving circuit comprises:

a data writing module, a drive module, a reset module and a light emission control module, wherein the data writing module and the drive module are electrically connected to a first node; the drive module and the light emission control module are electrically connected to a second node; the reset module and the light emission control module are each electrically connected to an anode of the light-emitting element; the reset module is electrically connected to a reset control signal line; and the light emission control module is electrically connected to a light emission control signal line; and the data writing module is configured to provide a data signal to the first node; the drive module is configured to drive the light-emitting element to emit light in a case where the light emission control module is turned on; and the reset module is configured to provide a reset signal to the anode of the light-emitting element.

13. The organic light-emitting display panel according to claim 12, wherein the light emission control module comprises a first transistor; the reset module comprises a second transistor; the first transistor is an NMOS transistor, and the second transistor is a PMOS transistor; or the second transistor is an NMOS transistor, and the first transistor is a PMOS transistor; and a light emission control signal line of a subpixel is further used as a reset control signal line of the subpixel.

14. The organic light-emitting display panel according to claim 12, wherein a current limiting resistor is connected in series between the light emission control module and the reset module.

15. The organic light-emitting display panel according to claim 12, further comprising a plurality of inverter groups, wherein each of the plurality of inverter groups comprises a first inverter and a first non-inverter;

the first inverter comprises a first PMOS transistor and a first NMOS transistor; and the first non-inverter comprises a second PMOS transistor and a second NMOS transistor;

a control terminal of the first PMOS transistor and a control terminal of the first NMOS transistor are electrically connected to a third node; a control terminal of the second PMOS transistor and a control terminal of the second NMOS transistor are each electrically connected to a fourth node; and the third node is electrically connected to the fourth node;

a first electrode of the first PMOS transistor and a second electrode of the second NMOS transistor are each electrically connected to a high-level signal terminal; and a second electrode of the first PMOS transistor and a first electrode of the first NMOS transistor are electrically connected to a fifth node;

a second electrode of the first NMOS transistor and a first electrode of the second PMOS transistor are each electrically connected to a low-level signal terminal; and a second electrode of the second PMOS transistor and a first electrode of the second NMOS transistor are electrically connected to a sixth node;

the fifth node is further electrically connected to a reset control signal line corresponding to subpixels having a same timing in a light emission stage; and the sixth node is further electrically connected to a light emission control signal line corresponding to the subpixels having the same timing in the light emission stage.

16. The organic light-emitting display panel according to claim 15, wherein a width-to-length ratio of the first PMOS transistor is greater than a width-to-length ratio of the second NMOS transistor; and a width-to-length ratio of the first NMOS transistor is less than a width-to-length ratio of the second PMOS transistor.

17. The organic light-emitting display panel according to claim 15, wherein the each of the plurality of inverter groups further comprises a first resistor—capacitor (RC) circuit, a second RC circuit, a third RC circuit and a fourth RC circuit;

the first RC circuit is electrically connected between the control terminal of the first PMOS transistor and the third node; and the second RC circuit is electrically connected between the control terminal of the first NMOS transistor and the third node;

the third RC circuit is electrically connected between the control terminal of the second PMOS transistor and the fourth node; and the fourth RC circuit is electrically connected between the control terminal of the second NMOS transistor and the fourth node;

a time constant of the first RC circuit is less than a time constant of the third RC circuit; and a time constant of the second RC circuit is greater than a time constant of the fourth RC circuit.

18. The organic light-emitting display panel according to claim 12, further comprising a plurality of inverter groups, wherein each of the plurality of inverter groups comprises a first inverter, a second inverter and a third inverter;

the first inverter comprises a first PMOS transistor and a first NMOS transistor; the second inverter comprises a second PMOS transistor and a second NMOS transistor; the third inverter comprises a third PMOS transistor and a third NMOS transistor; a control terminal of the first PMOS transistor and a control terminal of the first NMOS transistor are electrically connected to a third node; and a control terminal of the second PMOS transistor and a control terminal of the second NMOS transistor are electrically connected to a fourth node;

a control terminal of the third PMOS transistor and a control terminal of the third NMOS transistor are electrically connected to a fifth node; and a first electrode of the first PMOS transistor, a first electrode of the second PMOS transistor and a first electrode of the third PMOS transistor are each electrically connected to a high-level signal terminal; a second electrode of the first PMOS transistor and a first electrode of the first NMOS transistor are electrically connected to a sixth node; a second electrode of the first NMOS transistor, a second electrode of the second NMOS transistor and a second electrode of the third NMOS transistor are each electrically connected to a low-level signal terminal; a second electrode of the second PMOS transistor and a first electrode of the second NMOS transistor are electrically connected to a seventh node; a second electrode of the third PMOS transistor and a first electrode of the third NMOS transistor are electrically connected to an eighth node; the third node is electrically connected to the fourth node; the sixth node is further electrically connected to a reset control signal line corresponding to subpixels having a same timing in a light emission stage; the seventh node is electrically connected to the fifth node; and the eighth node is electrically connected to a light emission control signal line corresponding to the subpixels having the same timing in the light emission stage.

19. The organic light-emitting display panel according to claim 18, wherein a sum of a charging-and-discharging time constant of the second PMOS transistor and a charging-and-discharging time constant of the third NMOS transistor is greater than a charging-and-discharging time constant of the first PMOS transistor; and a sum of a charging-and-discharging time constant of the second NMOS transistor and a charging-and-discharging time constant of the third PMOS transistor is less than a charging-and-discharging time constant of the first NMOS transistor.

20. The organic light-emitting display panel according to claim 18, wherein the each of the plurality of inverter groups further comprises a first resistor-capacitor (RC) circuit; and the first RC circuit is located between the third node and the control terminal of the first NMOS transistor;

a sum of a charging-and-discharging time constant of the second PMOS transistor and a charging-and-discharging time constant of the third NMOS transistor is greater than a charging-and-discharging time constant of the first PMOS transistor; and a sum of a charging-and-discharging time constant of the second NMOS transistor and a charging-and-discharging time constant of the third PMOS transistor is less than a sum of a charging-and-discharging time constant of the first NMOS transistor and a time constant of the first RC circuit.

* * * * *